US007494424B2

(12) United States Patent
Williams et al.

(10) Patent No.: US 7,494,424 B2
(45) **Date of Patent: *Feb. 24, 2009**

(54) GOLF CLUB HEAD

(75) Inventors: Luke R. Williams, Carlsbad, CA (US); Larry G. Tang, Carlsbad, CA (US); Daniel M. Stevens, San Diego, CA (US); Ronald K. Hettinger, Oceanside, CA (US); Michael Hallack, Carlsbad, CA (US); Evan D. Gibbs, Encinitas, CA (US); Matthew T. Cackett, San Diego, CA (US); Alan Hocknell, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/868,638

(22) Filed: Oct. 8, 2007

(65) Prior Publication Data

US 2008/0039234 A1 Feb. 14, 2008

Related U.S. Application Data

(63) Continuation of application No. 11/625,176, filed on Jan. 19, 2007, now Pat. No. 7,291,075, which is a continuation of application No. 11/161,199, filed on Jul. 26, 2005, now Pat. No. 7,166,038.

(60) Provisional application No. 60/641,283, filed on Jan. 3, 2005.

(51) Int. Cl.
*A63B 53/04* (2006.01)

(52) U.S. Cl. ..... 473/329; 473/334; 473/335; 473/345; 473/349

(58) Field of Classification Search ..... 473/324–350, 473/257–292; D21/733–735, 749, 752, 759
See application file for complete search history.

(56) References Cited

U.S. PATENT DOCUMENTS

| | | | |
|---|---|---|---|
| 1,096,359 | A | 5/1914 | Dwight |
| 1,167,387 | A | 1/1916 | Daniel |
| 1,568,888 | A | 1/1926 | Dunn |
| 1,638,916 | A | 8/1927 | Butchart |
| 1,780,625 | A | 11/1930 | Mattern |
| 2,336,405 | A | 12/1943 | Kent |
| 2,750,194 | A | 6/1956 | Clark |
| D179,002 | S | 10/1956 | Hoffmeister |
| 3,397,888 | A | 8/1968 | Springer et al. |
| 3,486,755 | A | 12/1969 | Hodge |
| 3,572,709 | A | 3/1971 | Risher |
| 3,625,518 | A | 12/1971 | Solheim |
| 3,652,094 | A | 3/1972 | Glover |
| 3,692,306 | A | 9/1972 | Glover |

(Continued)

*Primary Examiner*—Sebastiano Passaniti
(74) *Attorney, Agent, or Firm*—Michael A. Catania; Elaine H. Lo

(57) ABSTRACT

A golf club head (42) having a substantially square or rectangular body is disclosed herein. The golf club head (42) preferably has a volume ranging from 420 cubic centimeters to 470 cubic centimeters. The golf club head (42) preferably has a moment of inertia about the Izz axis through the center of gravity of the golf club head greater than 4000 grams-centimeters squared, and a moment of inertia about the Ixx axis through the center of gravity of the golf club head greater than 3000 grams-centimeters squared.

20 Claims, 23 Drawing Sheets

U.S. PATENT DOCUMENTS

D226,431 S 3/1973 Baker
3,761,095 A 9/1973 Thompson
D229,431 S 11/1973 Baker
3,863,932 A 2/1975 Lezatte
3,897,066 A 7/1975 Belmont
3,901,514 A 8/1975 Priaulx
3,937,474 A 2/1976 Jepson et al.
3,941,390 A 3/1976 Hussey
3,955,820 A 5/1976 Cochran
3,966,210 A 6/1976 Rozmus
3,975,023 A 8/1976 Inamori
3,981,507 A 9/1976 Nunziato
3,989,248 A 11/1976 Campau
4,010,958 A 3/1977 Long
4,021,047 A 5/1977 Mader
4,085,934 A 4/1978 Churchward
D268,357 S 3/1983 Mader
4,398,965 A 8/1983 Campau
4,420,156 A 12/1983 Campau
4,568,088 A 2/1986 Kurahashi
4,575,447 A 3/1986 Hariguchi
4,762,322 A 8/1988 Molitor et al.
4,872,685 A 10/1989 Sun
4,877,249 A 10/1989 Thompson
4,898,387 A 2/1990 Finney
5,046,733 A 9/1991 Antonious
5,058,895 A 10/1991 Igarashi
5,106,094 A 4/1992 Desboilles et al.
5,141,230 A 8/1992 Antonious
5,154,425 A 10/1992 Niskanen
5,176,383 A 1/1993 Duclos
5,193,811 A 3/1993 Okumoto
5,251,901 A 10/1993 Solheim et al.
5,273,283 A 12/1993 Bowland
5,282,624 A 2/1994 Viste
5,306,008 A 4/1994 Kinoshita
5,310,185 A 5/1994 Viollaz et al.
5,344,140 A 9/1994 Anderson
5,346,216 A 9/1994 Aizawa
5,346,217 A 9/1994 Tsuchiya et al.
5,354,055 A 10/1994 MacKeil
5,377,986 A 1/1995 Viollaz et al.
5,398,935 A 3/1995 Katayama
5,410,798 A 5/1995 Lo
5,421,577 A 6/1995 Kobayashi
5,425,538 A 6/1995 Vincent et al.
5,431,401 A 7/1995 Smith
5,447,309 A 9/1995 Vincent
5,464,210 A 11/1995 Davis et al.
5,474,296 A 12/1995 Schmidt et al.
5,485,998 A 1/1996 Kobayashi
5,499,814 A 3/1996 Lu
5,516,107 A 5/1996 Okumoto et al.
5,547,427 A 8/1996 Rigal et al.
5,570,886 A 11/1996 Rigal et al.
5,624,331 A 4/1997 Lo et al.
5,743,813 A 4/1998 Chen et al.
5,776,011 A 7/1998 Su et al.
5,830,084 A 11/1998 Kosmatka
5,836,830 A 11/1998 Onuki et al.
5,851,160 A 12/1998 Rugge et al.
5,863,261 A 1/1999 Eggiman
5,888,148 A 3/1999 Allen
5,947,838 A 9/1999 Tkacs
D415,807 S 10/1999 Werner
5,971,867 A 10/1999 Galy
5,985,197 A 11/1999 Nelson et al.
6,012,989 A 1/2000 Saksun
6,017,280 A 1/2000 Hubert
6,048,278 A 4/2000 Meyer et al.
6,123,627 A 9/2000 Antonious
6,146,571 A 11/2000 Vincent et al.
6,149,534 A 11/2000 Peters et al.
6,152,833 A 11/2000 Werner et al.
6,165,081 A 12/2000 Chou
6,248,026 B1 6/2001 Wanchena
6,310,185 B1 10/2001 Wallace et al.
6,319,148 B1 11/2001 Tom
6,332,848 B1 12/2001 Long et al.
6,334,817 B1 1/2002 Ezawa et al.
6,348,015 B1 2/2002 Kosmatka
6,354,962 B1 3/2002 Galloway et al.
6,390,933 B1 5/2002 Galloway et al.
6,406,381 B2 6/2002 Murphy et al.
6,428,427 B1 8/2002 Kosmatka
6,478,692 B2 11/2002 Kosmatka
6,488,594 B1 12/2002 Card et al.
6,582,323 B2 6/2003 Soracco et al.
6,602,149 B1 8/2003 Jacobson
6,607,452 B2 8/2003 Helmstetter et al.
6,648,773 B1 11/2003 Evans
D489,105 S 4/2004 Kim
6,719,645 B2 * 4/2004 Kouno ..... 473/345
6,860,824 B2 3/2005 Evans
6,875,129 B2 4/2005 Erickson et al.
6,991,558 B2 1/2006 Beach et al.
7,025,692 B2 4/2006 Erickson et al.
D524,890 S 7/2006 Foster et al.
7,070,517 B2 7/2006 Cackett et al.
7,118,493 B2 10/2006 Galloway
7,121,955 B2 10/2006 Stevens et al.
7,163,468 B2 * 1/2007 Gibbs et al. ..... 473/329
7,166,038 B2 * 1/2007 Williams et al. ..... 473/329
7,169,060 B2 * 1/2007 Stevens et al. ..... 473/329
7,278,927 B2 * 10/2007 Gibbs et al. ..... 473/329
7,291,075 B2 * 11/2007 Williams et al. ..... 473/329
7,306,527 B2 * 12/2007 Williams et al. ..... 473/329
7,311,613 B2 * 12/2007 Stevens et al. ..... 473/329
7,390,269 B2 * 6/2008 Williams et al. ..... 473/329
7,407,448 B2 * 8/2008 Stevens et al. ..... 473/329
2004/0192468 A1 * 9/2004 Onoda et al. ..... 473/345
2005/0043112 A1 2/2005 Stevens et al.
2005/0239576 A1 10/2005 Stites et al.
2005/0288124 A1 12/2005 Galloway et al.
2006/0058115 A1 3/2006 Erickson et al.
2007/0026962 A1 2/2007 Galloway et al.

* cited by examiner

GOLF CLUB HEAD

CROSS REFERENCES TO RELATED APPLICATIONS

The Present application is a continuation of U.S. patent application Ser. No. 11/625,176, filed on Jan. 19, 2007, which is a continuation of U.S. patent application Ser. No. 11/161,199, filed on Jul. 26, 2005, now U.S. Pat. No. 7,166,038, which claims priority to U.S. Provisional Patent Application No. 60/641,283, filed Jan. 3, 2005, now abandoned.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head. More specifically, the present invention relates to a substantially square or substantially rectangular golf club head.

2. Description of the Related Art

When a golf club head strikes a golf ball, large impacts are produced that load the club head face and the golf ball. Most of the energy is transferred from the head to the golf ball, however, some energy is lost as a result of the collision. The golf ball is typically composed of polymer cover materials (such as ionomers) surrounding a rubber-like core. These softer polymer materials having damping (loss) properties that are strain and strain rate dependent which are on the order of 10-100 times larger than the damping properties of a metallic club face. Thus, during impact most of the energy is lost as a result of the high stresses and deformations of the golf ball (0.001 to 0.20 inch), as opposed to the small deformations of the metallic club face (0.025 to 0.050 inch). A more efficient energy transfer from the club head to the golf ball could lead to greater flight distances of the golf ball.

The generally accepted approach has been to increase the stiffness of the club head face to reduce metal or club head deformations. However, this leads to greater deformations in the golf ball, and thus increases in the energy transfer problem.

Some have recognized the problem and disclosed possible solutions. An example is Campau, U.S. Pat. No. 4,398,965, for a Method Of Making Iron Golf Clubs With Flexible Impact Surface, which discloses a club having a flexible and resilient face plate with a slot to allow for the flexing of the face plate. The face plate of Campau is composed of a ferrous material, such as stainless steel, and has a thickness in the range of 0.1 inches to 0.125 inches.

Another example is Eggiman, U.S. Pat. No. 5,863,261, for a Golf Club Head With Elastically Deforming Face And Back Plates, which discloses the use of a plurality of plates that act in concert to create a spring-like effect on a golf ball during impact. A fluid is disposed between at least two of the plates to act as a viscous coupler.

Yet another example is Jepson et al, U.S. Pat. No. 3,937,474, for a Golf Club With A Polyurethane Insert. Jepson discloses that the polyurethane insert has a hardness between 40 and 75 shore D.

Still another example is Inamori, U.S. Pat. No. 3,975,023, for a Golf Club Head With Ceramic Face Plate, which discloses using a face plate composed of a ceramic material having a high energy transfer coefficient, although ceramics are usually harder materials. Chen et al., U.S. Pat. No. 5,743, 813 for a Golf Club Head, discloses using multiple layers in the face to absorb the shock of the golf ball. One of the materials is a non-metal material.

Lu, U.S. Pat. No. 5,499,814, for a Hollow Club Head With Deflecting Insert Face Plate, discloses a reinforcing element composed of a plastic or aluminum alloy that allows for minor deflecting of the face plate which has a thickness ranging from 0.01 to 0.30 inches for a variety of materials including stainless steel, titanium, KEVLAR®, and the like. Yet another Campau invention, U.S. Pat. No. 3,989,248, for a Golf Club Having Insert Capable Of Elastic Flexing, discloses a wood club composed of wood with a metal insert.

Although not intended for flexing of the face plate, Viste, U.S. Pat. No. 5,282,624, discloses a golf club head having a face plate composed of a forged stainless steel material and having a thickness of 3 mm. Anderson, U.S. Pat. No. 5,344,140, for a Golf Club Head And Method Of Forming Same, also discloses the use of a forged material for the face plate. The face plate of Anderson may be composed of several forged materials including steel, copper and titanium. The forged plate has a uniform thickness of between 0.090 and 0.130 inch.

Another invention directed toward forged materials in a club head is Su et al., U.S. Pat. No. 5,776,011 for a Golf Club Head. Su discloses a club head composed of three pieces with each piece composed of a forged material. The main objective of Su is to produce a club head with greater loft angle accuracy and reduce structural weaknesses. Aizawa, U.S. Pat. No. 5,346,216 for a Golf Club Head, discloses a face plate having a curved ball hitting surface.

U.S. Pat. No. 6,146,571 to Vincent, et. al., discloses a method of manufacturing a golf club head wherein the walls are obtained by injecting a material, such as plastic, over an insert affixed to a meltable core. The core has a melt point lower than that of the injectable plastic material so that once the core is removed, an inner volume is maintained to form the inner cavity. The insert may comprise a resistance element for reinforcing the internal portion of the front wall of the shell upon removal of the core where the reinforcement element is comprised of aluminum with a laterally extending portion comprised of steel.

U.S. Pat. No. 6,149,534 to Peters, et al., discloses a golf club head having upper and lower metal engagement surfaces formed along a single plane interface wherein the metal of the lower surface is heavier and more dense than the metal of the upper surface.

U.S. Pat. Nos. 5,570,886 and 5,547,427 to Rigal, et al., disclose a golf club head of molded thermoplastic having a striking face defined by an impact-resistant metallic sealing element. The sealing element defines a front wall of the striking surface of the club head and extends upward and along the side of the impact surface to form a neck for attachment of the shaft to the club head. The sealing element preferably being between 2.5 and 5 mm in thickness.

U.S. Pat. No. 5,425,538 to Vincent, et al., discloses a hollow golf club head having a steel shell and a composite striking surface composed of a number of stacked woven webs of fiber.

U.S. Pat. No. 5,377,986 to Viollaz, et al., discloses a golf club head having a body composed of a series of metal plates and a hitting plate comprised of plastic or composite material wherein the hitting plate is imparted with a forwardly convex shape. Additionally, U.S. Pat. No. 5,310,185 to Viollaz, et al., discloses a hollow golf club head having a body composed of a series of metal plates, a metal support plate being located on the front hitting surface to which a hitting plate comprised of plastic or composite is attached. The metal support plate has a forwardly convex front plate associated with a forwardly convex rear plate of the hitting plate thereby forming a forwardly convex hitting surface.

U.S. Pat. No. 5,106,094 to Desboilles, et al., discloses a golf club head having a metal striking face plate wherein the striking face plate is a separate unit attached to the golf club head with a quantity of filler material in the interior portion of the club head.

U.S. Pat. No. 4,568,088 to Kurahashi discloses a wooden golf club head body reinforced by a mixture of wood-plastic composite material. The wood-plastic composite material is unevenly distributed such that a higher density in the range of between 5 and 15 mm lies adjacent to and extends substantially parallel with the front face of the club head.

U.S. Pat. No. 4,021,047 to Mader discloses a golf club wherein the sole plate, face plate, heel, toe and hosel portions are formed as a unitary cast metal piece and wherein a wood or composite crown is attached to this unitary piece thereby forming a hollow chamber in the club head.

U.S. Pat. No. 5,624,331 to Lo, et al. discloses a hollow metal golf club head where the metal casing of the head is composed of at least two openings. The head also contains a composite material disposed within the head where a portion of the composite material is located in the openings of the golf club head casing.

U.S. Pat. No. 1,167,387 to Daniel discloses a hollow golf club head wherein the shell body is comprised of metal such as aluminum alloy and the face plate is comprised of a hard wood, such as beech, persimmon or the like. The face plate is aligned such that the wood grain presents endwise at the striking plate.

U.S. Pat. No. 3,692,306 to Glover discloses a golf club head having a bracket with sole and striking plates formed integrally thereon. At least one of the plates has an embedded elongate tube for securing a removably adjustable weight means.

U.S. Pat. No. 5,410,798 to Lo discloses a method of manufacturing a composite golf club head using a metal casing to which a laminated member is inserted. A sheet of composite material is subsequently layered over the openings of the laminated member and metal casing to close off the openings in the top of both. An expansible pocket is then inserted into the hollow laminated member comprising sodium nitrite, ammonium chloride and water causing the member to attach integrally to the metal casing when the head is placed into a mold and heated.

U.S. Pat. No. 4,877,249 to Thompson discloses a wood golf club head embodying a laminated upper surface and metallic sole surface having a keel. In order to reinforce the laminations and to keep the body from delaminating upon impact with an unusually hard object, a bolt is inserted through the crown of the club head where it is connected to the sole plate at the keel and tightened to compress the laminations.

U.S. Pat. No. 3,897,066 to Belmont discloses a wooden golf club head having removably inserted weight adjustment members. The members are parallel to a central vertical axis running from the face section to the rear section of the club head and perpendicular to the crown to toe axis. The weight adjustment members may be held in place by the use of capsules filled with polyurethane resin, which can also be used to form the faceplate. The capsules have openings on a rear surface of the club head with covers to provide access to adjust the weight means.

U.S. Pat. No. 2,750,194 to Clark discloses a wooden golf club head with weight adjustment means. The golf club head includes a tray member with sides and bottom for holding the weight adjustment preferably cast or formed integrally with the heel plate. The heel plate with attached weight member is inserted into the head of the golf club via an opening.

U.S. Pat. No. 5,193,811 to Okumoto, et al. discloses a wood type club head body comprised primarily of a synthetic resin and a metallic sole plate. The metallic sole plate has on its surface for bonding with the head body integrally formed members comprising a hosel on the heel side, weights on the toe and rear sides and a beam connecting the weights and hosel. Additionally, U.S. Pat. No. 5,516,107 to Okumoto, et al., discloses a golf club head having an outer shell, preferably comprised of synthetic resin, and metal weight member/s located on the interior of the club head. A foamable material is injected into the hollow interior of the club to form the core. Once the foamable material has been injected and the sole plate is attached, the club head is heated to cause the foamable material to expand thus holding the weight member/s in position in recess/es located in toe, heel and/or back side regions by pushing the weight member/s into the inner surface of the outer shell.

U.S. Pat. No. 4,872,685 to Sun discloses a wood type golf club head wherein a female unit is mated with a male unit to form a unitary golf club head. The female unit comprises the upper portion of the golf club head and is preferably composed of plastic, alloy, or wood. The male unit includes the structural portions of sole plate, a face insert consists of the striking plate and weighting elements. The male unit has a substantially greater weight and is preferably composed of a light metal alloy. The units are mated or held together by bonding and or mechanical means.

U.S. Pat. No. 5,398,935 to Katayama discloses a wood golf club head having a striking face wherein the height of the striking face at a toe end of the golf club head is nearly equal to or greater than the height of the striking face at the center of the club head.

U.S. Pat. No. 1,780,625 to Mattern discloses a club head with a rear portion composed of a light-weight metal, such as magnesium. U.S. Pat. No. 1,638,916 to Butchart discloses a golf club with a balancing member composed of persimmon or a similar wood material, and a shell-like body composed of aluminum attached to the balancing member.

U.S. Pat. No. 3,981,507 to Nunziato discloses a cube-like club head to provide a rectangular face.

U.S. Pat. No. 2,336,405 to Kent discloses a golf club with a trapezoidal shaped club head.

U.S. Pat. No. D226,431 to Baker discloses a design for a club head with a greater rear-wall.

U.S. Pat. No. 3,397,888 to Springer et al., discloses a putter head with a rectangular shape.

U.S. Pat. No. 3,486,755 to Hodge discloses a putter with a triangular-like shape.

U.S. Pat. No. 3,901,514 discloses a putter with a club head shaped like a ring.

U.S. Pat. No. D179,002 to Hoffmeister discloses a design for a club head with a circular face and an elongated body.

The Rules of Golf, established and interpreted by the United States Golf Association ("USGA") and The Royal and Ancient Golf Club of Saint Andrews, set forth certain requirements for a golf club head. The requirements for a golf club head are found in Rule 4 and Appendix II. A complete description of the Rules of Golf are available on the USGA web page at www.usga.org. One such limitation is the volume of the golf club head.

Existing large volume driver heads (>400 cc) composed of conventional materials (titanium, steel) and conventional manufacturing methods (casting, forging, MIM, machining, etc.) are limited in the amount of discretionary material available for increasing the moments of inertia of the golf club head. Conventional golf club head shapes also limit the moments of inertia possible for any given volume golf club head.

BRIEF SUMMARY OF THE INVENTION

One aspect of the present invention is a substantially square golf club head with a moment of inertia, Izz, about the center of gravity of the golf club head that exceeds 4000 grams-centimeter squared.

Another aspect of the present invention is a multi-material substantially square golf club head including a metallic face component and a non-metallic aft-body component that is bonded to the face component.

Yet another aspect of the present invention is a golf club head comprising a front wall, a heel, an aft wall and a toe wall. The front wall has a perimeter. The heel wall extends 2.5 inches to 4.5 inches rearward from the perimeter of the front wall. The aft wall is substantially perpendicular to the heel wall and the aft wall extends from 2.5 inches to 4.5 inches from an aft edge of the heel wall. The toe wall is substantially perpendicular to the aft wall and the toe wall extends from 2.5 inches to 4.5 inches from an aft edge of the toe wall.

The heel wall, the aft wall and the toe wall preferably each have the same height. The heel wall, the aft wall and the toe wall preferably each have a height ranging from 1.5 inches to 3.0 inches. The golf club head preferably has a volume that ranges from 350 cubic centimeters to 500 cubic centimeters, and even more preferably ranges from 400 cubic centimeters to 460 cubic centimeters.

Another aspect of the present invention is a golf club head with a body having a front wall, a crown wall, a sole wall, a heel wall, an aft wall, and a toe wall, in which the body has a volume ranging from 350 cubic centimeters to 500 cubic centimeters and each of the aft wall, the toe wall and the heel wall is substantially straight.

The golf club head preferably has a geometric center point, an aft-heel edge point and an aft-toe edge point, in which the distance from the geometric center point to the aft-heel edge point is equal to the distance from the geometric center point to the aft-toe edge point. The golf club head may also include an aft-heel curvature section between the aft wall and the heel wall, and an aft-toe curvature section between the aft wall and the toe wall. Each of the aft-heel curvature section and the aft-toe curvature section preferably has a curvature length ranging from 0.5 inch to 1.0 inch. The heel wall preferably extends rearward from a perimeter of the front wall a distance of least 50% of the length of the heel wall at an angle of 80 degrees to 90 degrees relative to a plane parallel to the farthest extent of the face. The heel wall more preferably extends rearward from a perimeter of the front wall a distance of least 66% of the length of the heel wall at an angle of 80 degrees to 90 degrees relative to a plane parallel to the farthest extent of the face. The heel wall even more preferably extends rearward from a perimeter of the front wall a distance of least 75% of the length of the heel wall at an angle of 80 degrees to 90 degrees relative to a plane parallel to the farthest extent of the face. The heel wall yet even more preferably extends rearward from a perimeter of the front wall a distance of least 90% of the length of the heel wall at an angle of 80 degrees to 90 degrees relative to a plane parallel to the farthest extent of the face. The heel wall yet even more preferably extends rearward from a perimeter of the front wall a distance of least 95% of the length of the heel wall at an angle of 70 degrees to 90 degrees relative to a plane parallel to the farthest extent of the face. The distance from the geometric center point to the aft-heel edge point and the distance from the geometric center point to the aft-toe edge point are preferably the greatest lengths of the geometric center point to a location on the golf club head.

Another aspect of the present invention is a substantially square golf club head with a face component and an aft-body. The face component is composed of a first material, and includes a striking plate portion and a return portion. The return portion extends a distance ranging from 0.25 inch to 1.5 inches from a perimeter of the striking plate portion. The square aft-body is coupled to the return portion of the face component. The aft-body is composed of a second material having a density less than that of the first material. Each aft-body includes a crown portion and a sole portion. The sole portion has a bottom section and a ribbon section with the ribbon section being located between the crown portion and the bottom section of the sole portion.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
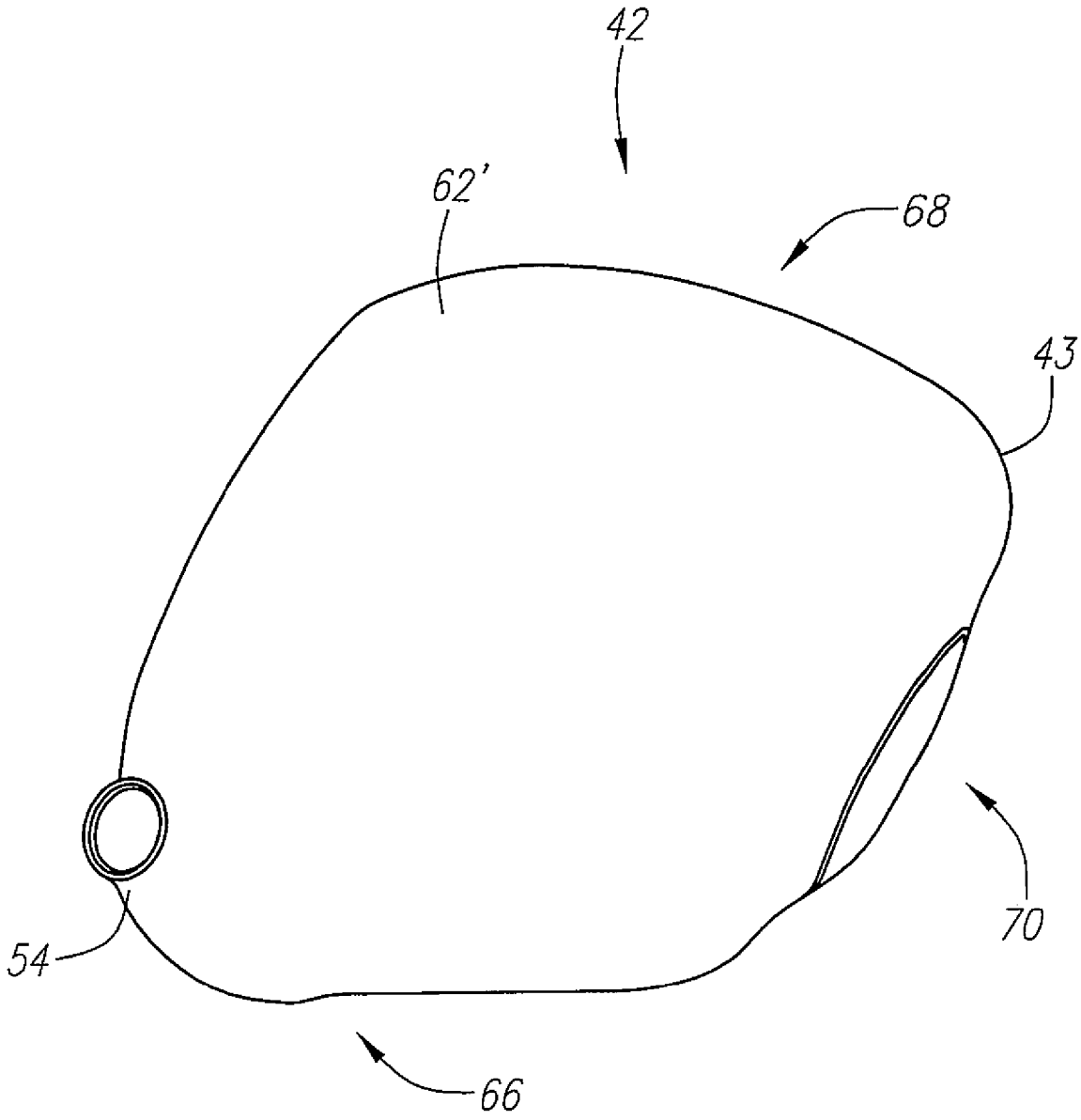
FIG. 1 is a perspective view of a club head of the present invention.

The present invention is generally directed at a golf club head that has a substantially square or rectangular shape as viewed from the top or bottom (as opposed to a side view) and has a relatively high moment of inertia Izz about the center of gravity of the golf club head. A general embodiment of the club head is illustrated in FIGS. 1-7. A preferred embodiment of the club head is illustrated in FIGS. 10-16. An alternative embodiment of the club head is illustrated in FIGS. 22-27. A second alternative embodiment of the club head is illustrated in FIGS. 28-33. A third alternative embodiment of the club head is illustrated in FIGS. 34-39. Although five embodiments are illustrated, those skilled in the pertinent art will recognize from this disclosure that other embodiments of the golf club head of the present invention are possible without departing from the scope and spirit of the present invention.

As shown in FIGS. 1-7, a golf club head of the present invention is generally designated 42. Preferably, a body 43 of the golf club head has a crown 62', a sole 64', a ribbon 90', and a striking plate 72', all of which preferably define a hollow interior. The golf club head 42 has a heel end 66, a toe end 68 an aft end 70.

The golf club head 42, when designed as a driver, preferably has a volume from 200 cubic centimeters to 600 cubic centimeters, more preferably from 300 cubic centimeters to 500 cubic centimeters, and most preferably from 420 cubic centimeters to 470 cubic centimeters, with a most preferred volume of 460 cubic centimeters. The volume of the golf club head 42 will also vary between fairway woods (preferably ranging from 3-woods to eleven woods) with smaller volumes than drivers.

The golf club head 42, when designed as a driver, preferably has a mass no more than 215 grams, and most preferably a mass of 180 to 215 grams. When the golf club head 42 is designed as a fairway wood, the golf club head preferably has a mass of 135 grams to 200 grams, and preferably from 140 grams to 165 grams.

Figure 1A:
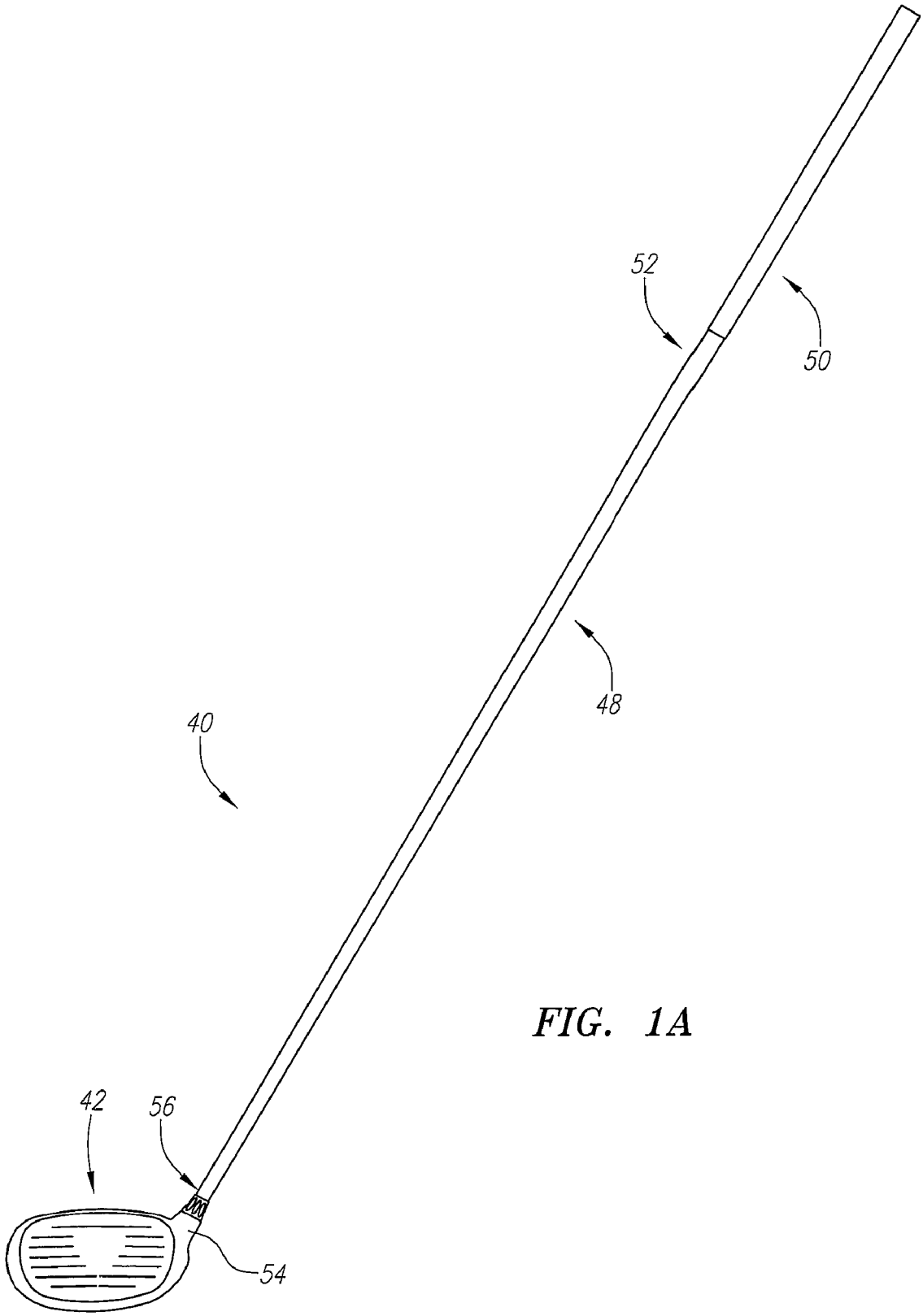
FIG. 1A is a front view of a golf club of the present invention.
Figure 2:
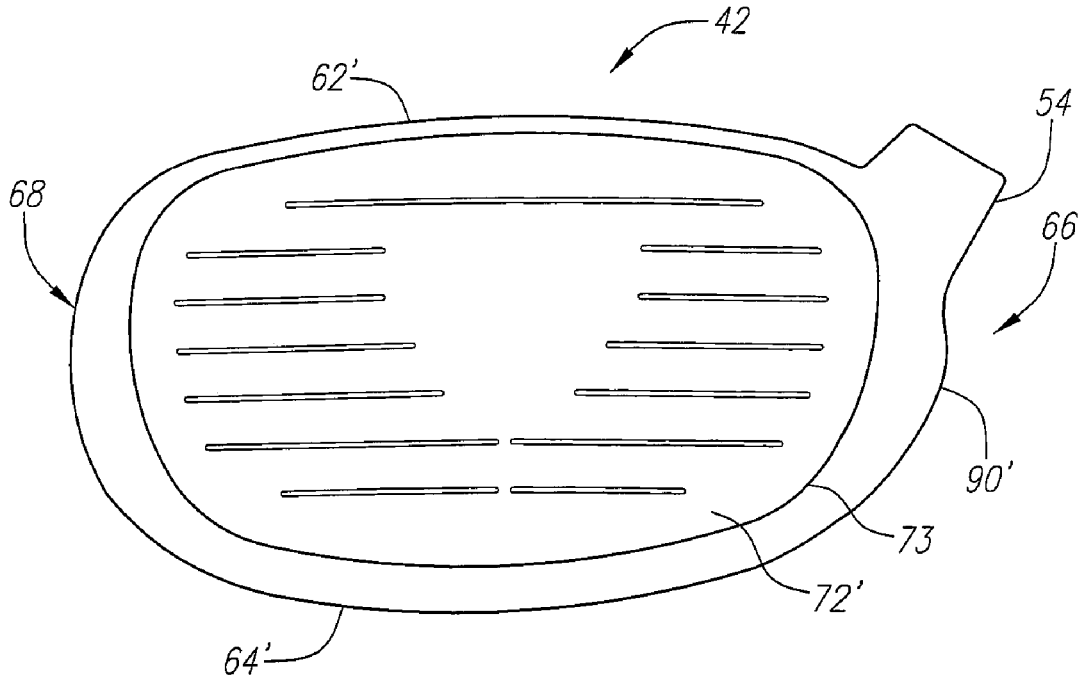
FIG. 2 is a front view of the club head of FIG. 1.

As shown in FIG. 1A, a golf club 40 has a substantially square golf club head 42. Engaging the club head 42 is a shaft 48 that has a grip 50 at a butt end 52 of the shaft 48 and is inserted into a hosel 54 of the club head 42 at a tip end 56 of the shaft 48.

Figure 8:
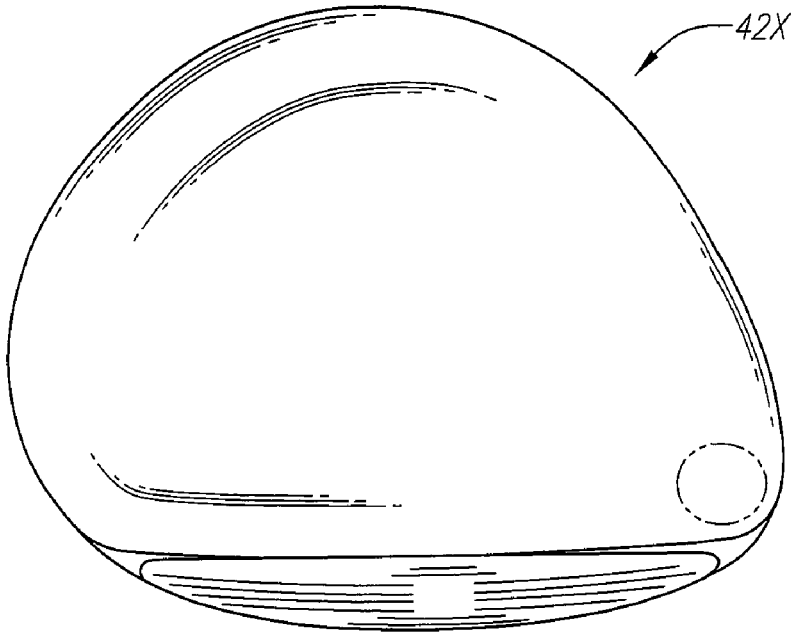
FIG. 8 (PRIOR ART)
FIG. 8 is a top plan view of a club head of the prior art.
Figure 9:
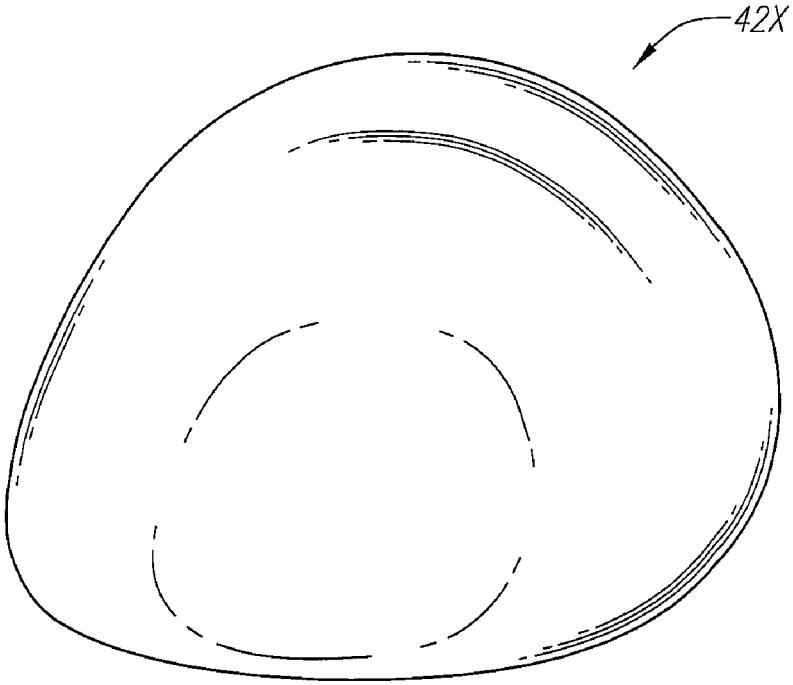
FIG. 9 (PRIOR ART)
FIG. 9 is a bottom plan view of the club head of FIG. 8.
Figure 10:
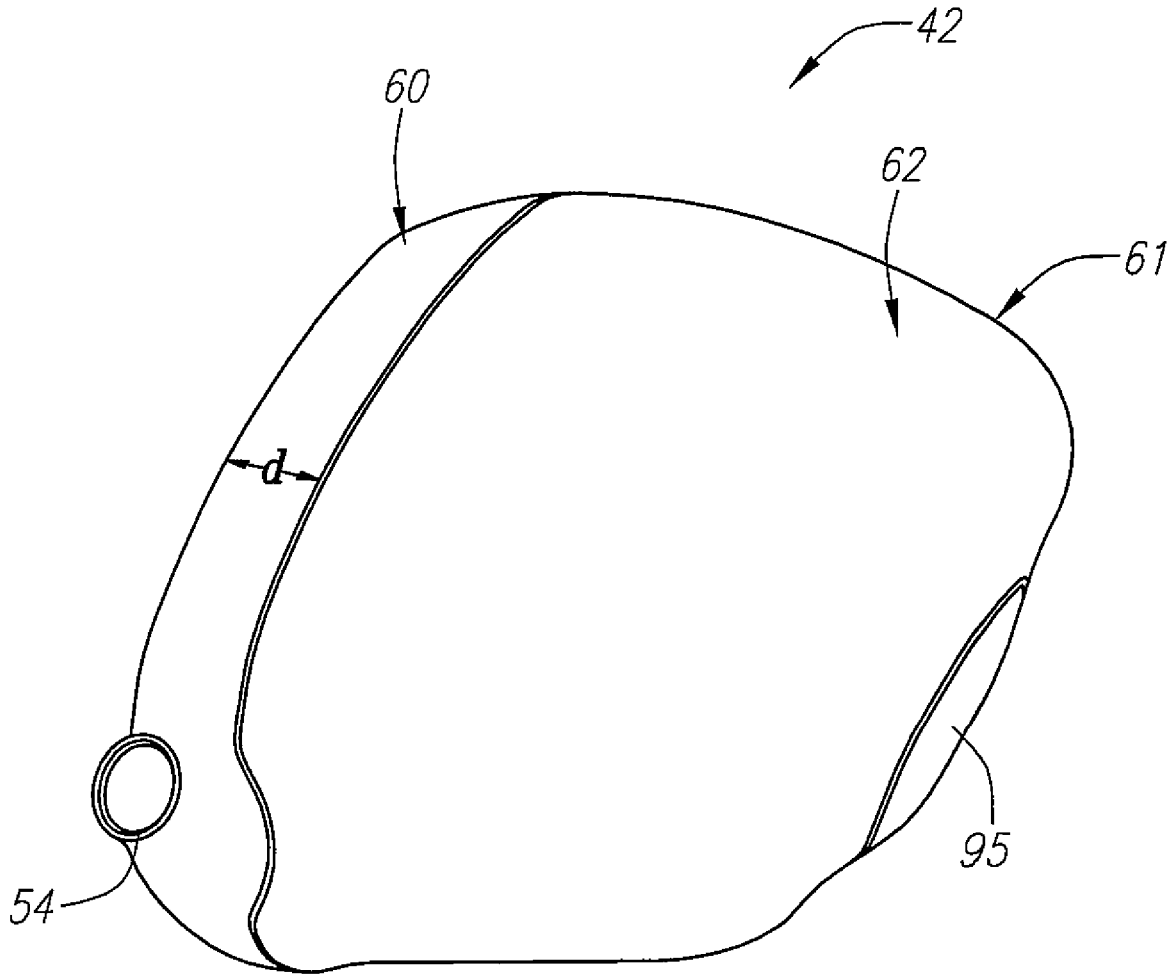
FIG. 10 is a perspective view of a preferred embodiment of the club head of the present invention.
Figure 11:
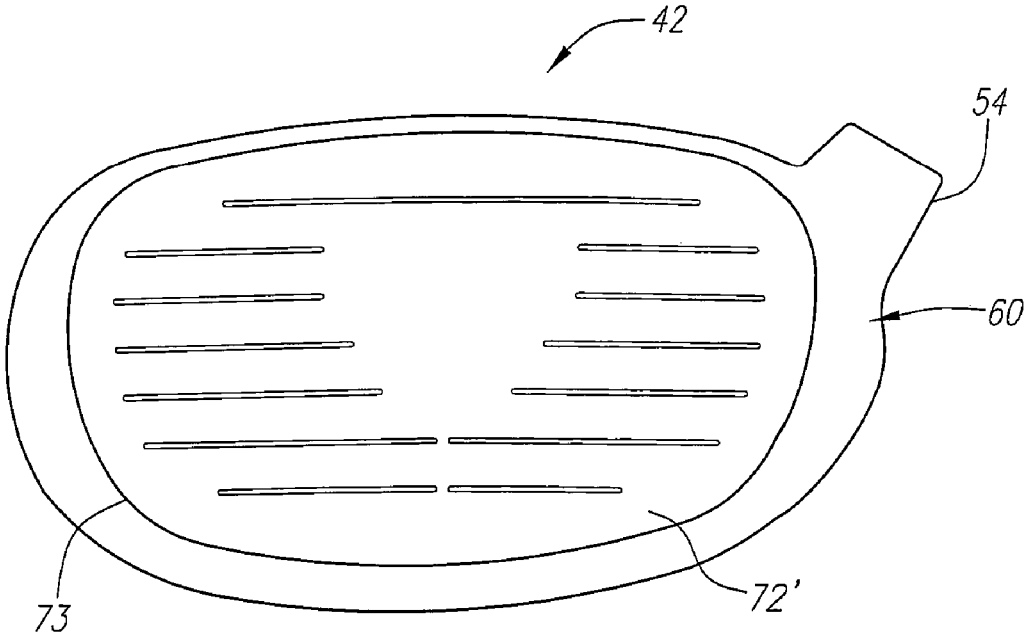
FIG. 11 is a front view of the club head of FIG. 10.
Figure 12:
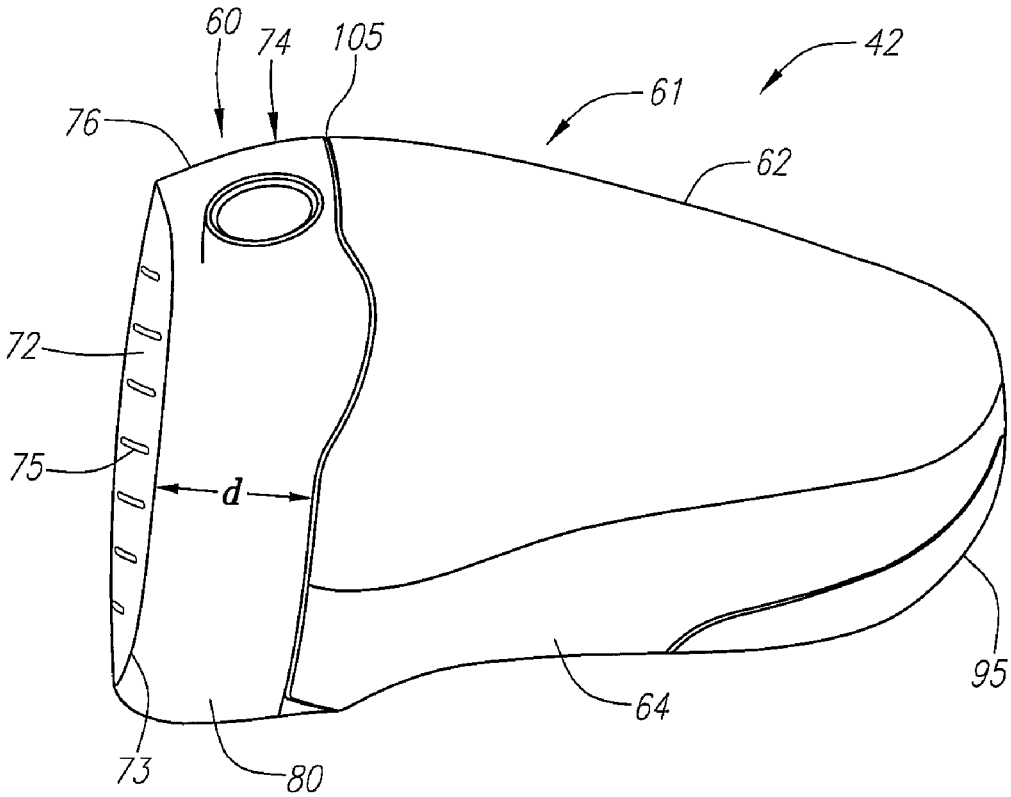
FIG. 12 is a heel side view of the club head of FIG. 10.
Figure 13:
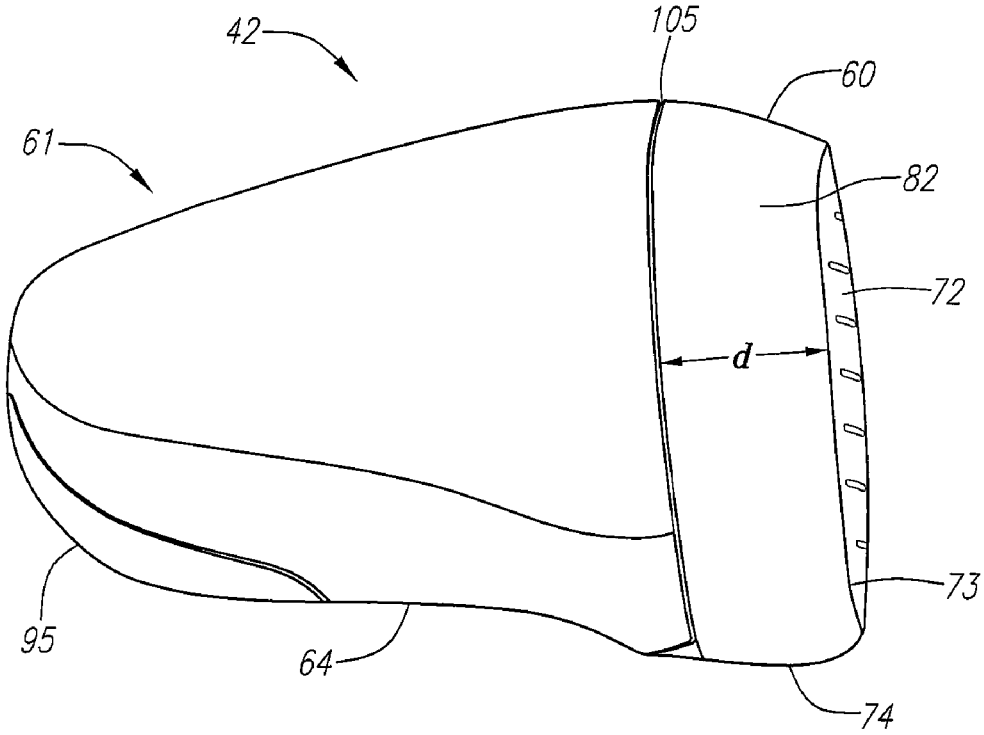
FIG. 13 is a toe side view of the club head of FIG. 10.
Figure 14:
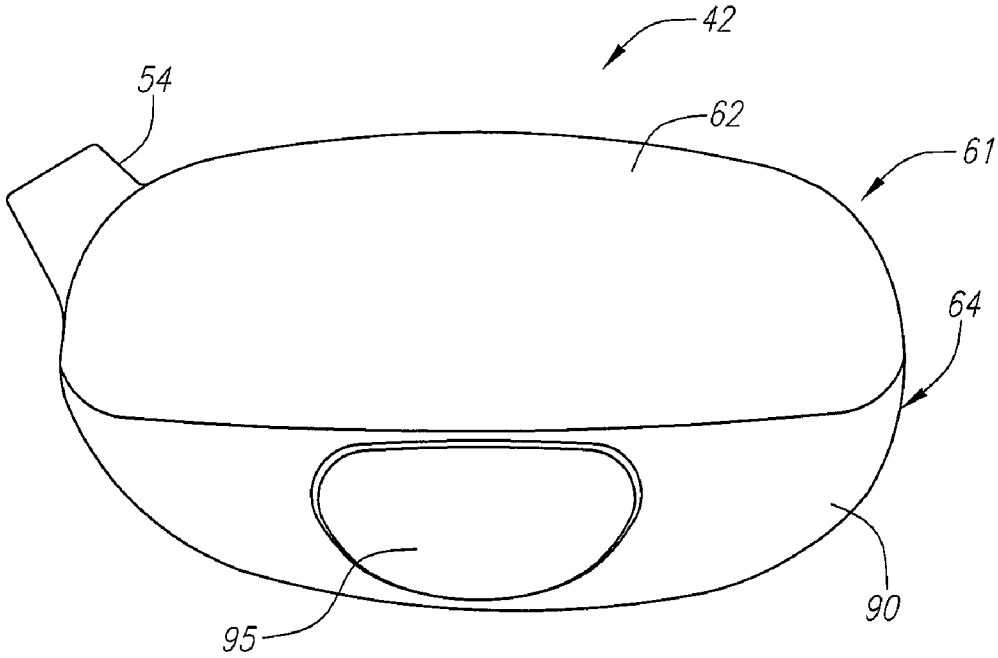
FIG. 14 is a rear plan view of the club head of FIG. 10.
Figure 15:
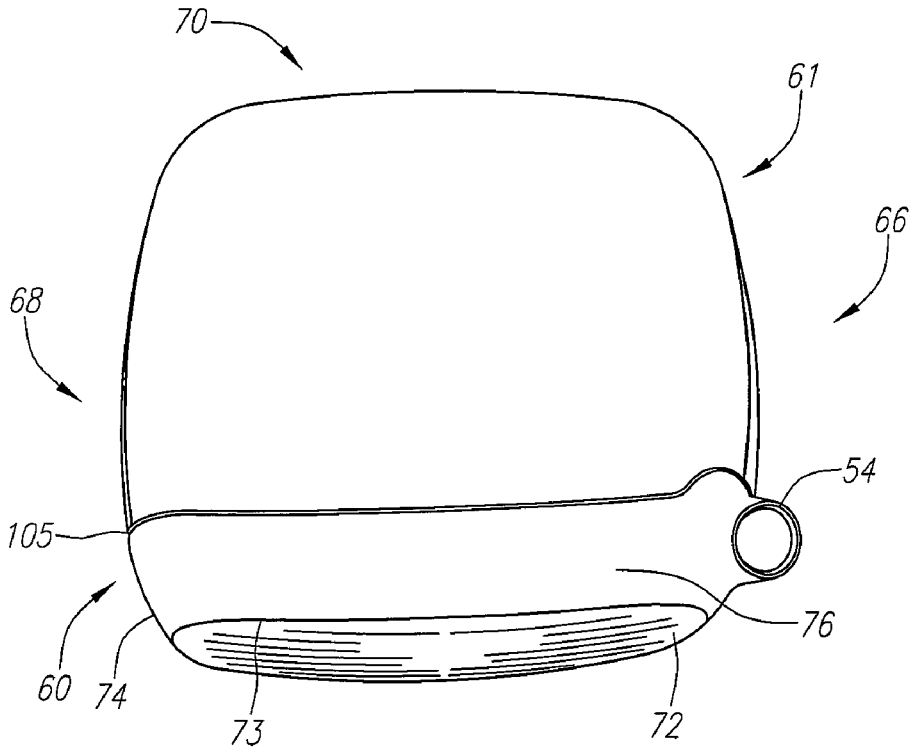
FIG. 15 is a top plan view of the club head of FIG. 10.
Figure 16:
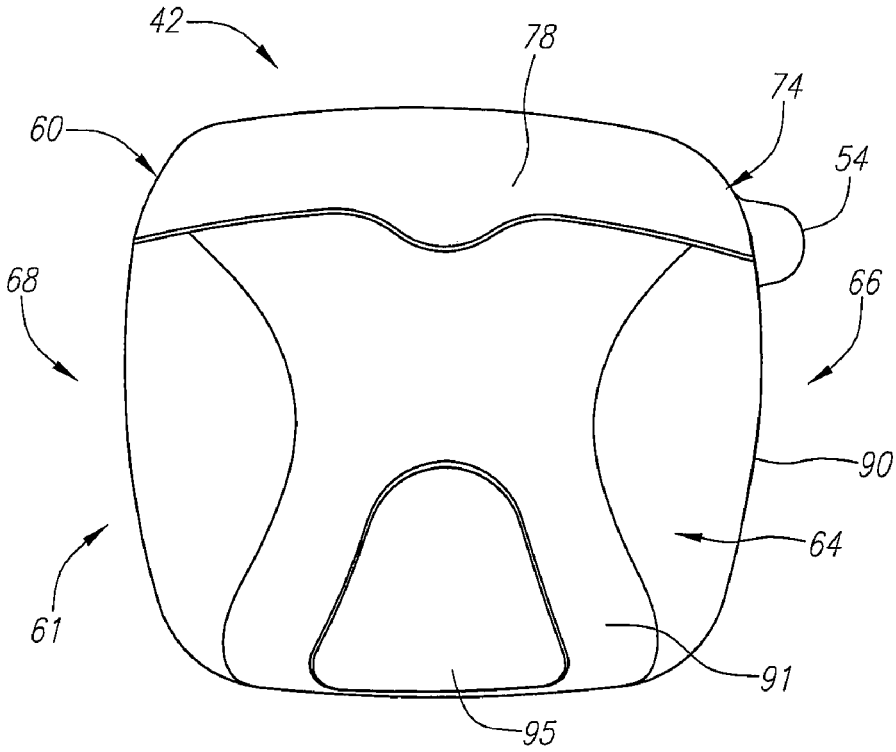
FIG. 16 is a bottom plan view of the club head of FIG. 10.
Figure 17:
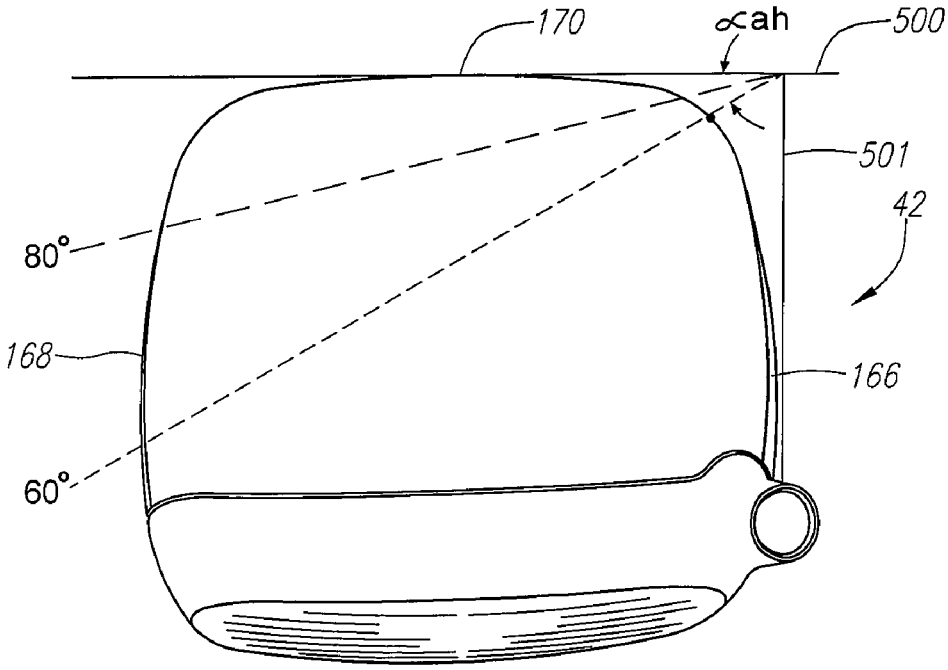
FIG. 17 is a top plan view of a club head of the present invention illustrating the wall angles relative to each other.
Figure 18:
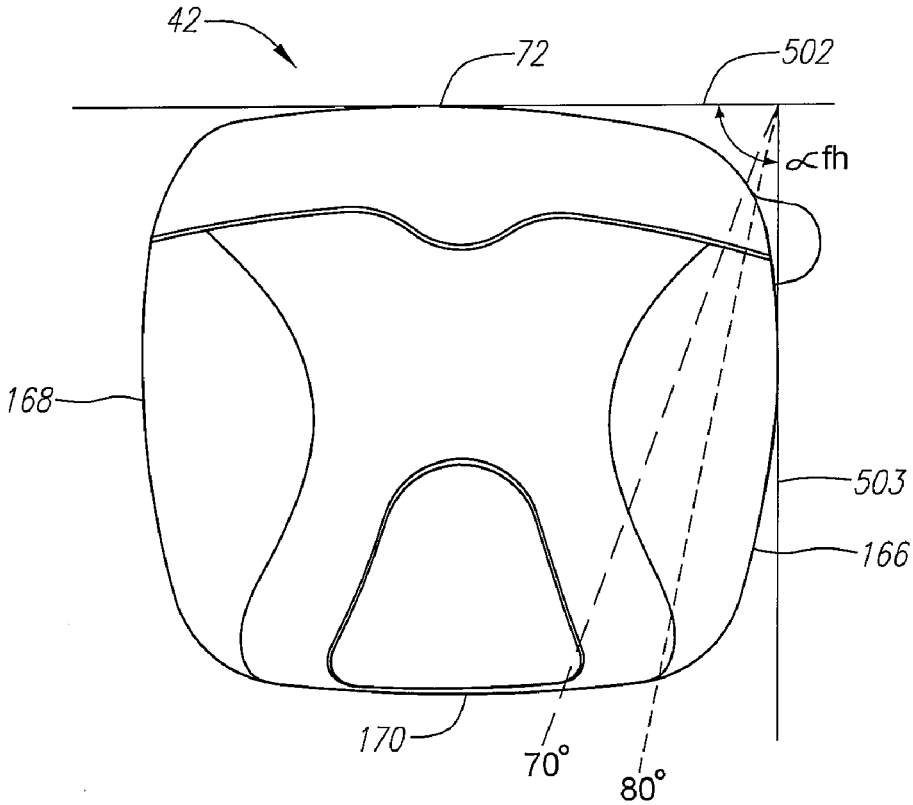
FIG. 18 is a bottom plan view of a club head of the present invention illustrating the wall angles relative to each other.
Figure 19:
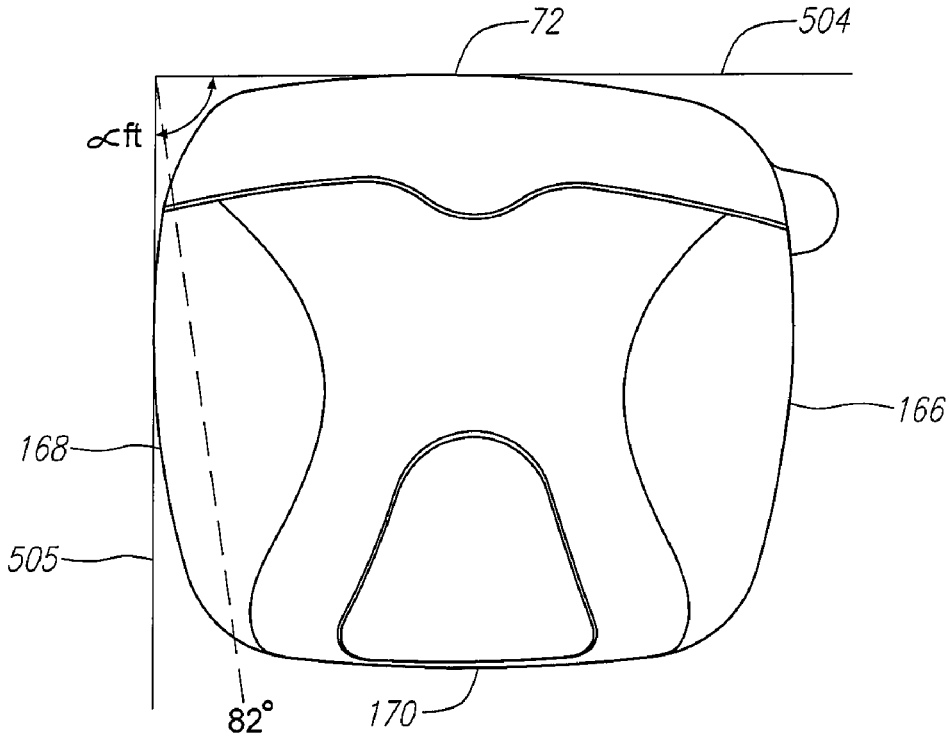
FIG. 19 is a bottom plan view of a club head of the present invention illustrating the wall angles relative to each other.
Figure 20:
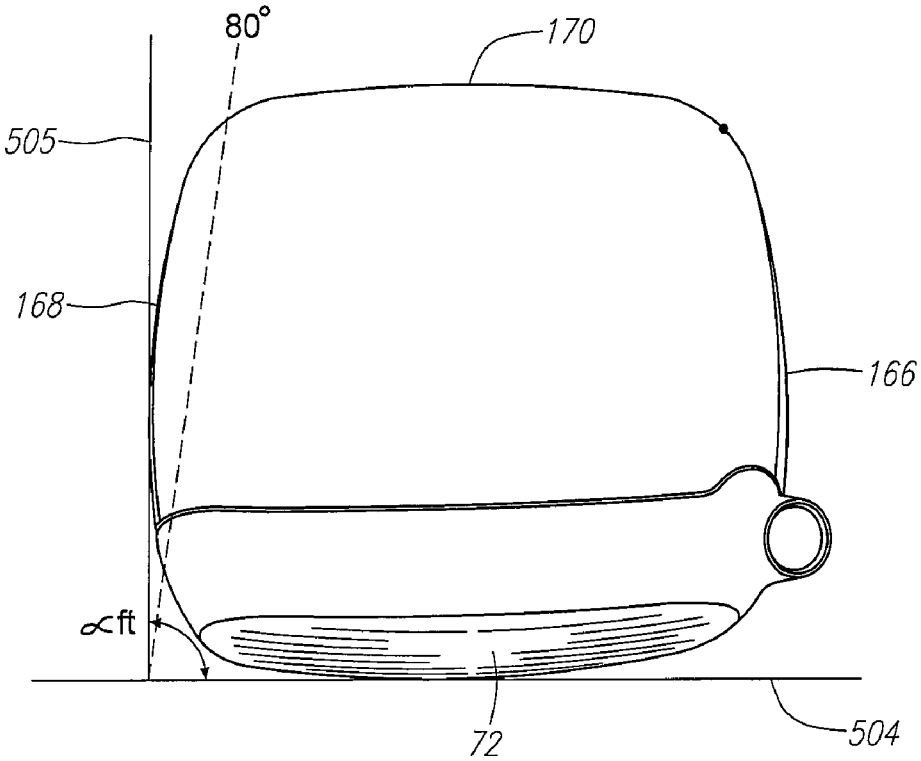
FIG. 20 is a top plan view of a club head of the present invention illustrating the wall angles relative to each other.

The club head 42 has a heel wall 166, a toe wall 168 and a rear wall 170 that are substantially straight relative to each other and the striking plate 72' of the club head 42. Further, the heel wall 166, the toe wall 168 and the rear wall 170 is each substantially straight when compared to the walls of a prior art club head shown in FIGS. 8 and 9.

Figure 3:
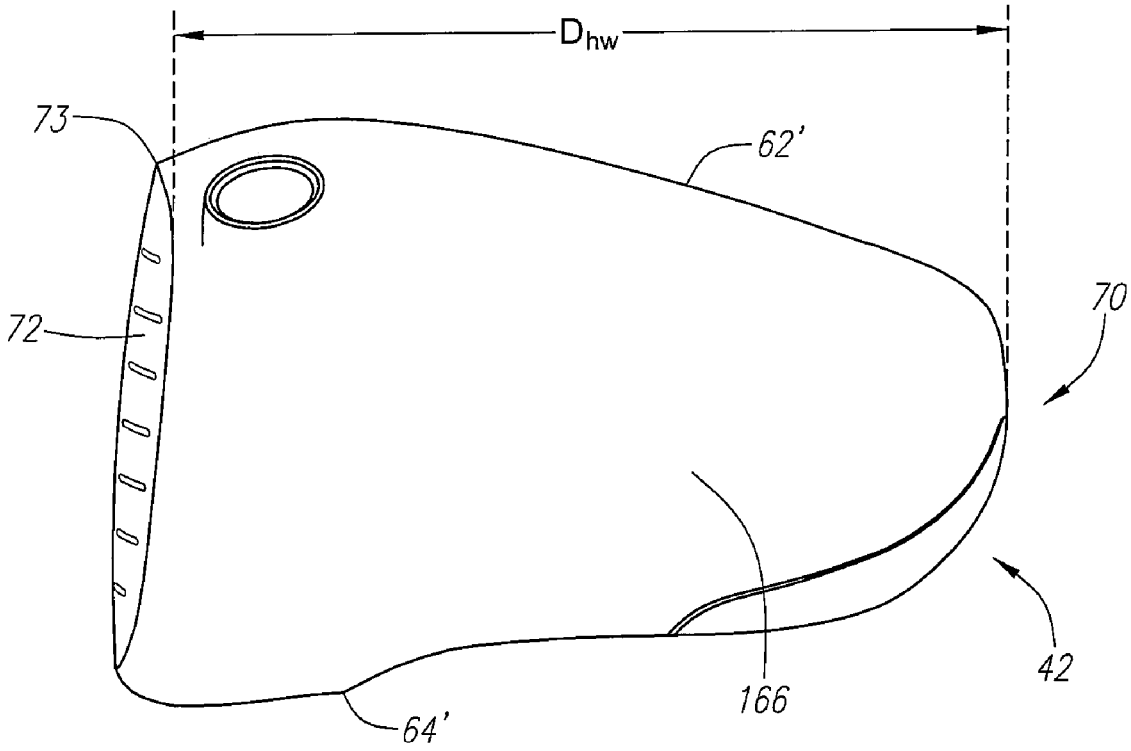
FIG. 3 is a heel side view of the club head of FIG. 1.

As shown in FIG. 3, the heel wall 166 has a distance, "Dhw", from a perimeter 73 of the striking plate 72' to a furthest rearward extent of the club head 42 that preferably ranges from 2.00 to 5.00 inches, more preferably from 3.0 to 4.5 inches, and most preferably from 3.5 to 4.0 inches.

Figure 4:
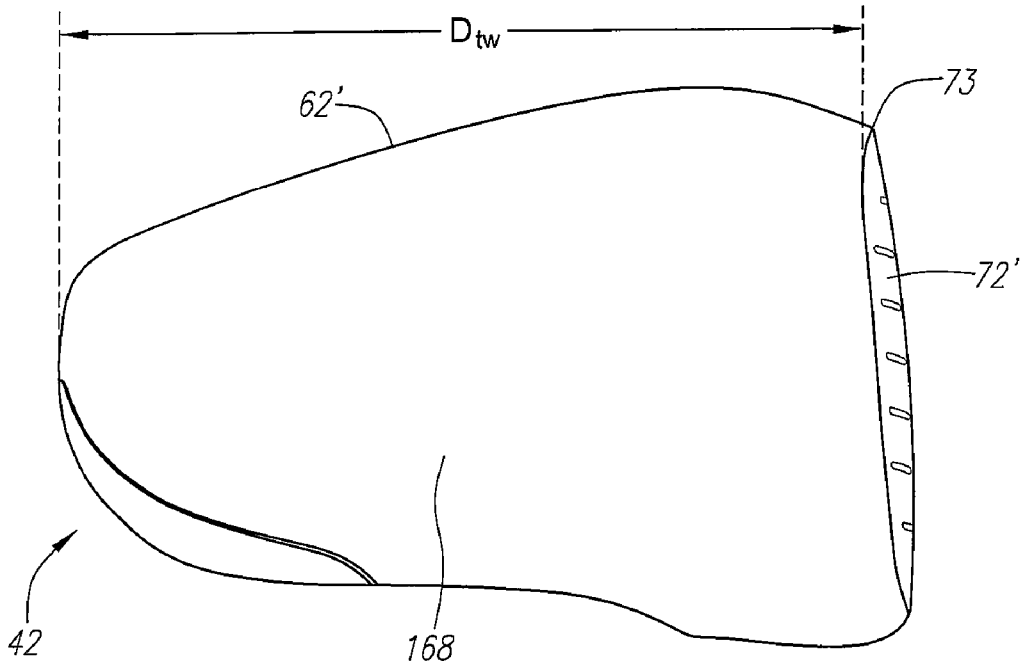
FIG. 4 is a toe side view of the club head of FIG. 1.

As shown in FIG. 4, the toe wall 168 has a distance, "Dtw", from a perimeter 73 of the striking plate 72' to a furthest rearward extent of the club head 42 that preferably ranges from 2.00 to 5.00 inches, more preferably from 3.0 to 4.5 inches, and most preferably from 3.5 to 4.0 inches.

Figure 5:
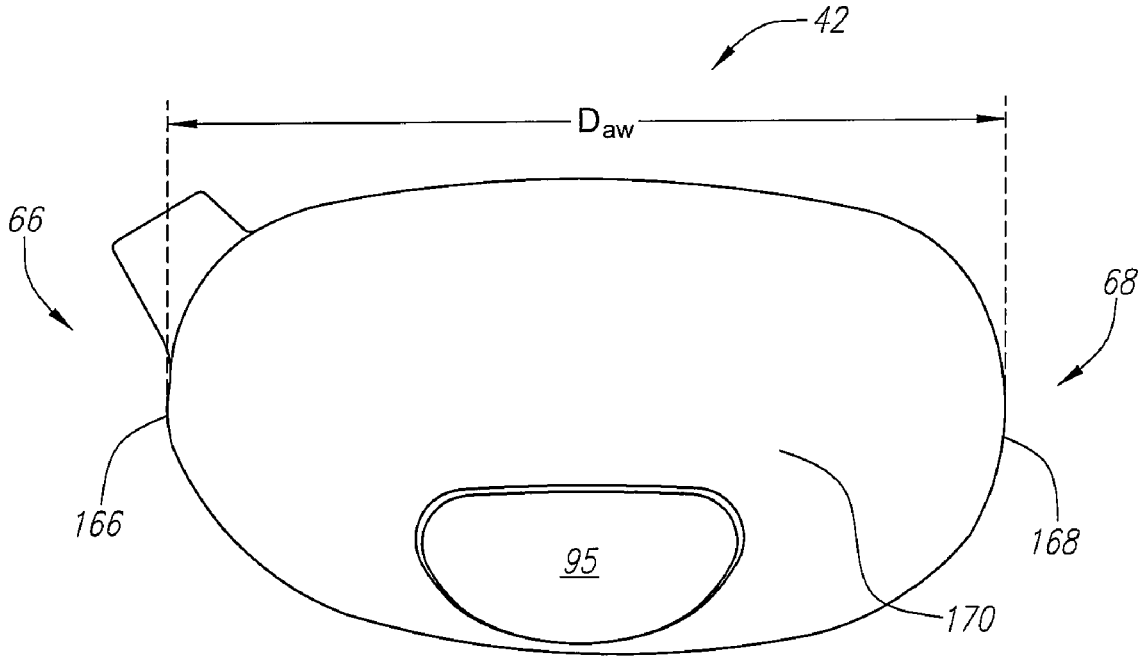
FIG. 5 is a rear plan view of the club head of FIG. 1.

As shown in FIG. 5, the rear wall 170 has a distance, "Daw", from a widest extent of the heel end 66 of the club head to a widest extent of the toe end 68 of the club head 42 that preferably ranges from 2.50 to 5.50 inches, more preferably from 3.0 to 4.75 inches, and most preferably from 4.0 to 4.5 inches.

In one embodiment, the distances Dhw, Dtw and Daw are all equal in length ranging from 3.5 to 4.25 inches. In an alternative embodiment, the distances Dhw and Dtw are equal in length ranging from 2.5 to 4.0 inches.

Figure 6:
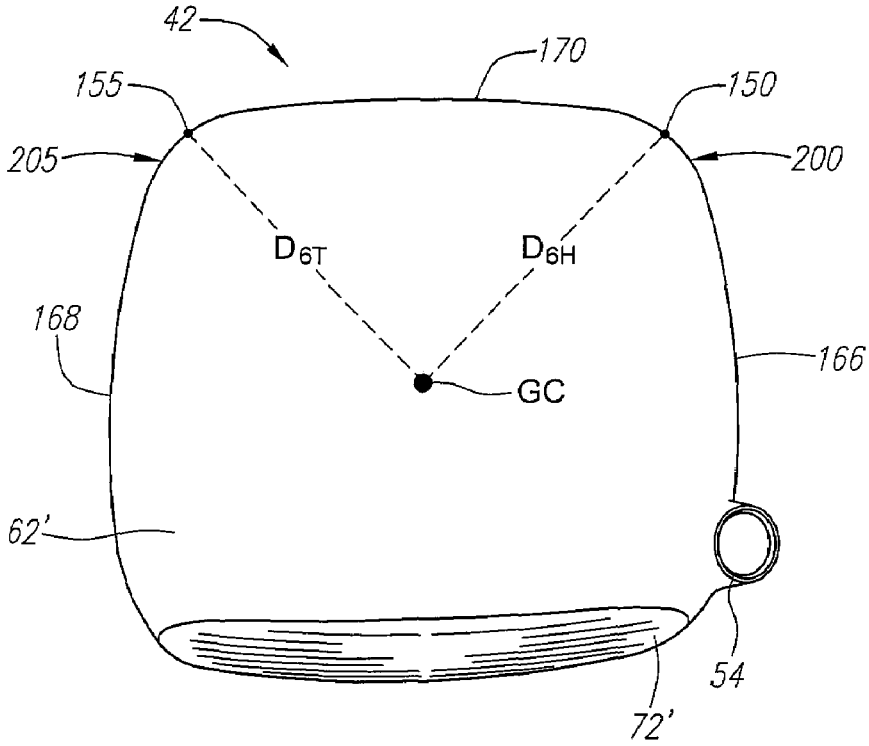
FIG. 6 is a top plan view of the club head of FIG. 1.

As shown in FIG. 6, a geometric center of the club head 42 is designated "GC." The geometric center is defined as the center based on the geometry of the club head 42. A distance "Dgh" from the geometric center to an aft-heel edge point 150 ranges from 1.5 inches to 3.5 inches, and more preferably from 2.0 inches to 3.0 inches, and is most preferably 2.5 inches. A distance "Dgt" from the geometric center to an aft-toe edge point 155 ranges from 1.5 inches to 3.5 inches, and more preferably from 2.0 inches to 3.0 inches, and is most preferably 2.5 inches. In a preferred embodiment, the distances Dgh and Dgt are the farthest distances of any point on the club head 42 from the geometric center. In an alternative embodiment, the distances Dgh and Dgt are at least equal to the farthest distances of any point on the club head 42 from the geometric center. The aft-heel edge point 150 is defined as the inflection point along the edge of the heel wall 166 and the rear wall 170 wherein the heel wall 166 transitions to the rear wall 170. The aft-toe edge point 155 is defined as the inflection point along the edge of the toe wall 168 and the rear wall 170 wherein the toe wall 168 transitions to the rear wall 170.

As shown in FIG. 6, the club head 42 has an aft-heel curvature section 200 and an aft-toe curvature section 205. The aft-heel curvature section 200 is the transition from the heel wall 166 to the rear wall 170. The aft-toe curvature section 205 is the transition from the toe wall 168 to the rear wall 170. The club head 42 of the present invention has a reduced curvature section as compared to club head 42*x* of the prior art.

Figure 7:
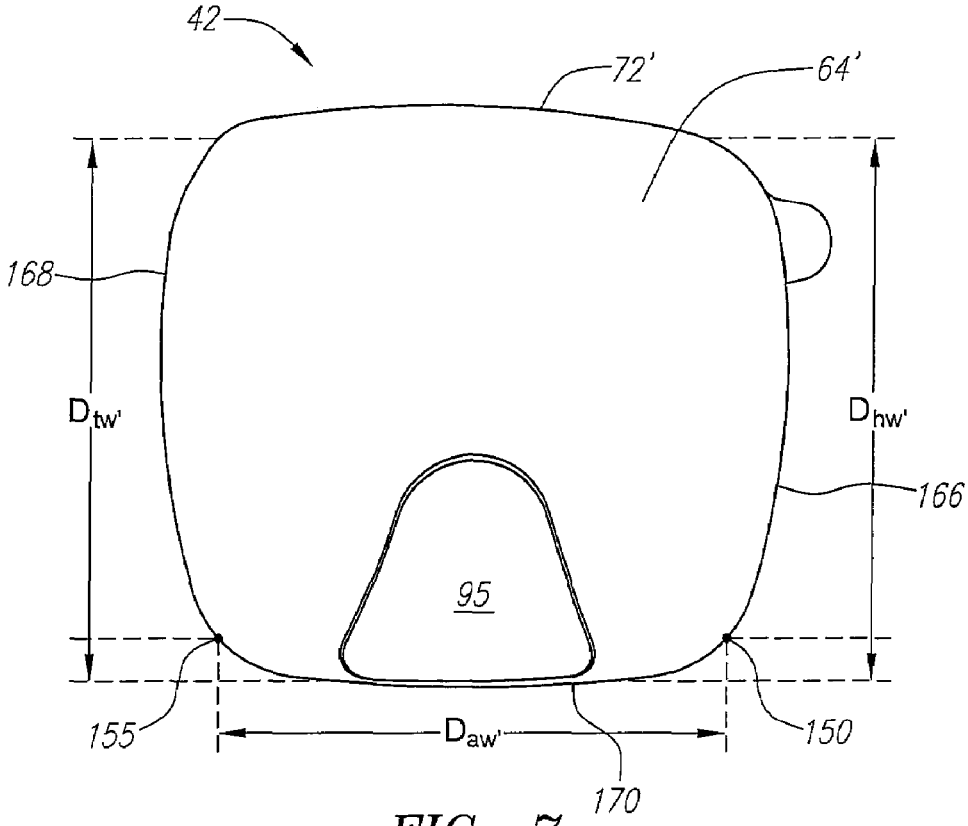
FIG. 7 is a bottom plan view of the club head of FIG. 1.

AS shown in FIG. 7, the heel wall 166 has a distance, "Dhw'", from a perimeter 73 of the striking plate 72' to the aft-heel edge point 150 that preferably ranges from 2.00 to 4.5 inches, more preferably from 2.5 to 4.25 inches, and most preferably from 3.0 to 4.0 inches.

As shown in FIG. 7, the toe wall 168 has a distance, "Dtw'", from a perimeter 73 of the striking plate 72' to the aft-toe edge point 155 that preferably ranges from 2.00 to 4.5 inches, more preferably from 2.5 to 4.25 inches, and most preferably from 3.0 to 4.0 inches.

As shown in FIG. 7, the rear wall 170 has a distance, "Daw'", from the aft-heel edge point 150 to the aft-toe edge point 155 that preferably ranges from 2.50 to 5.00 inches, more preferably from 3.0 to 4.0 inches, and most preferably from 3.25 to 3.75 inches. In a preferred embodiment, the distances Dhw' and Dtw' are equal in length ranging from 2.5 to 4.0 inches.

In a preferred embodiment, the club head 42 is generally composed of two components, a face component 60, and an aft-body 61, as shown in FIGS. 10-16. The aft-body 61 preferably has a crown portion 62 and a sole portion 64.

The face component 60 is generally composed of a single piece of metal, and is preferably composed of a forged metal material. More preferably, the forged metal material is a forged titanium material. Such titanium materials include pure titanium and titanium alloys such as 6-4 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. Other metals for the face component 60 include stainless steel, other high strength steel alloy metals and amorphous metals. Alternatively, the face component 60 is manufactured through casting, forming, machining, powdered metal forming, metal-injection-molding, electro chemical milling, and the like.

The face component 60 generally includes a striking plate portion (also referred to herein as a face plate) 72 and a return portion 74 extending laterally inward from a perimeter 73 of the striking plate portion 72. The striking plate portion 72 typically has a plurality of scorelines 75 thereon. The striking plate portion 72 preferably has a thickness ranging from 0.010 inch to 0.250 inch, and the return portion 74 preferably has a thickness ranging from 0.010 inch to 0.250 inch. The return portion 74 preferably extends a distance ranging from 0.25 inch to 1.5 inches from the perimeter 73 of the striking plate portion 72.

In a preferred embodiment, the return portion 74 generally includes an upper lateral section 76, a lower lateral section 78, a heel lateral section 80 and a toe lateral section 82. Thus, the return 74 preferably encircles the striking plate portion 72 a full 360 degrees. However, those skilled in the pertinent art will recognize that the return portion 74 may only encompass a partial section of the striking plate portion 72, such as 270 degrees or 180 degrees, and may also be discontinuous.

The upper lateral section 76 preferably extends inward, towards the aft-body 61, a predetermined distance, d, to engage the crown 62. In a preferred embodiment, the predetermined distance ranges from 0.2 inch to 1.2 inch, more preferably 0.40 inch to 1.0 inch, and most preferably 0.8 inch, as measured from the perimeter 73 of the striking plate portion 72 to the rearward edge of the upper lateral section 76. In a preferred embodiment, the upper lateral section 76 is substantially straight and substantially parallel to the striking plate portion 72 from the heel end 66 to the toe end 68.

The perimeter 73 of the striking plate portion 72 is preferably defined as the transition point where the face component 60 transitions from a plane substantially parallel to the striking plate portion 72 to a plane substantially perpendicular to the striking plate portion 72. Alternatively, one method for determining the transition point is to take a plane parallel to the striking plate portion 72 and a plane perpendicular to the striking plate portion, and then take a plane at an angle of forty-five degrees to the parallel plane and the perpendicular plane. Where the forty-five degrees plane contacts the face component is the transition point thereby defining the perimeter of the striking plate portion 72.

The heel lateral section 80 is substantially perpendicular to the striking plate portion 72, and the heel lateral section 80 preferably covers a portion of the hosel 54 before engaging an optional ribbon section 90 and a bottom section 91 of the sole portion 64 of the aft-body 61. The heel lateral section 80 is attached to the sole portion 64, both the ribbon section 90 and the bottom section 91, as explained in greater detail below. The heel lateral section 80 extends inward a distance, d, from the perimeter 73 a distance of 0.2 inch to 1.2 inch, more preferably 0.40 inch to 1.0 inch, and most preferably 0.8 inch. The heel lateral section 80 is preferably straight at its edge.

At the other end of the face component 60 is the toe lateral section 82. The toe lateral section 82 is preferably attached to the sole 64, both the ribbon 90 and the bottom section 91, as explained in greater detail below. The toe lateral section 82 extends inward a distance, d, from the perimeter 73 a distance of 0.2 inch to 1.2 inch, more preferably 0.40 inch to 1.0 inch, and most preferably 0.8 inch. The toe lateral section 82 preferably is preferably straight at its edge.

The lower lateral section 78 extends inward, toward the aft-body 61, a distance, d, to engage the sole portion 64. In a preferred embodiment, the distance d ranges from 0.2 inch to 1.2 inch, more preferably 0.40 inch to 1.0 inch, and most preferably 0.8 inch, as measured from the perimeter 73 of the striking plate portion 72 to the edge of the lower lateral section 78.

The aft-body 61 is preferably composed of a non-metal material, preferably a composite material such as continuous fiber pre-preg material (including thermosetting materials or a thermoplastic materials for the resin). Other materials for the aft-body 61 include other thermosetting materials or other thermoplastic materials such as injectable plastics. Alternatively, the aft-body 61 is composed of low-density metal materials, such as magnesium or aluminum. Exemplary magnesium alloys are available from Phillips Plastics Corporation under the brands AZ-91-D (nominal composition of magnesium with aluminum, zinc and manganese), AM-60-B (nominal composition of magnesium with aluminum and manganese) and AM-50-A (nominal composition of magnesium with aluminum and manganese). The aft-body 61 is preferably manufactured through metal-injection-molding. Alternatively, the aft-body 61 is manufactured through casting, forming, machining, powdered metal forming, electro chemical milling, and the like.

The aft-body 61 is preferably manufactured through bladder-molding, resin transfer molding, resin infusion, injection molding, compression molding, or a similar process. In a preferred process, the face component 60, with an adhesive on the interior surface of the return portion 74, is placed within a mold with a preform of the aft-body 61 for bladder molding. Such adhesives include thermosetting adhesives in a liquid or a film medium. A preferred adhesive is a two part liquid epoxy sold by 3M of Minneapolis Minn. under the brand names DP420NS and DP460NS. Other alternative adhesives include modified acrylic liquid adhesives such as DP810NS, also sold by the 3M company. Alternatively, foam tapes such as Hysol Synspan may be utilized with the present invention.

A bladder is placed within the hollow interior of the preform and face component 60, and is pressurized within the mold, which is also subject to heating. The co-molding process secures the aft-body 61 to the face component 60. Alternatively, the aft-body 61 is bonded to the face component 60 using an adhesive, or mechanically secured to the return portion 74.

The crown portion 62 of the aft-body 61 is generally convex toward the sole 64, and engages the ribbon section 90 of sole portion 64 outside of the engagement with the face member 60. The crown portion 62 preferably has a thickness in the range of 0.010 to 0.100 inch, more preferably in the range of 0.025 inch to 0.070 inch, even more preferably in the range of 0.028 inch to 0.040 inch, and most preferably has a thickness of 0.033 inch. The sole portion 64, including the bottom section 91 and the optional ribbon section 90, which is substantially perpendicular to the bottom section 91, preferably has a thickness in the range of 0.010 to 0.100 inch, more preferably in the range of 0.025 inch to 0.070 inch, even more preferably in the range of 0.028 inch to 0.040 inch, and most preferably has a thickness of 0.033 inch. In a preferred embodiment, the aft-body 61 is composed of a plurality of plies of pre-preg, typically six or seven plies, such as disclosed in U.S. Pat. No. 6,248,025, entitled Composite Golf Head And Method Of Manufacturing, which is hereby incorporated by reference in its entirety.

The hosel 54 is preferably at least partially disposed within the hollow interior of the club head 42, and is preferably located as a part of the face component 60. The hosel 54 is preferably composed of a similar material to the face component 60, and is preferably secured to the face component 60 through welding or the like. Alternatively, the hosel 54 may be formed with the formation of the face component 60.

In a preferred embodiment, a weight member 122 is preferably positioned on the aft body 61 to increase the moment of inertia of the club head 42, to influence the center of gravity, or influence other inherent properties of the golf club head 42. The weight member 122 is preferably composed of tungsten loaded film, tungsten doped polymers, or similar weighting mechanisms such as described in U.S. Pat. No. 6,386,990, filed on Dec. 29, 1999, entitled A Composite Golf Club Head With An Integral Weight Strip, and hereby incorporated by reference in its entirety. Those skilled in the pertinent art will recognize that other high density materials, such as lead-free pewter, may be utilized as an optional weight without departing from the scope and spirit of the present invention.

In a preferred embodiment two weight members 122*a* and 122*b* are embedded within the plies of pre-preg of the ribbon section 90 of the sole portion 64 of the aft-body 61. Individually, each of weight 122 has a mass ranging from 5 grams to 30 grams. Each weight 122 is preferably composed of a material that has a density ranging from 5 grams per cubic centimeters to 20 grams per cubic centimeters, more preferably from 7 grams per cubic centimeters to 12 grams per cubic centimeters.

Each weight 122 is preferably composed of a polymer material integrated with a metal material. The metal material is preferably selected from copper, tungsten, steel, aluminum, tin, silver, gold, platinum, or the like. A preferred metal is tungsten due to its high density. The polymer material is a thermoplastic or thermosetting polymer material. A preferred polymer material is polyurethane, epoxy, nylon, polyester, or similar materials. A most preferred polymer material is a thermoplastic polyurethane. A preferred weight 122 is an injection molded thermoplastic polyurethane integrated with tungsten to have a density of 8.0 grams per cubic centimeters. In a preferred embodiment, each weight 122 is composed of from 50 to 95 volume percent polyurethane and from 50 to 5 volume percent tungsten. Also, in a preferred embodiment, each weight 122 is composed of from 10 to 25 weight percent polyurethane and from 90 to 75 weight percent tungsten.

Preferably, the weights 122*a-b* are positioned in the aft-heel corner and the aft-toe corner of the golf club head 42 generally corresponding to the aft-heel edge point 150 and the aft-toe edge point 155. Those skilled in the pertinent art will recognize that other weighting materials may be utilized for the weight 122 without departing from the scope and spirit of the present invention. The placement of the weights 122 allows for the moment of inertia of the golf club head 42 to be optimized.

Figure 40:
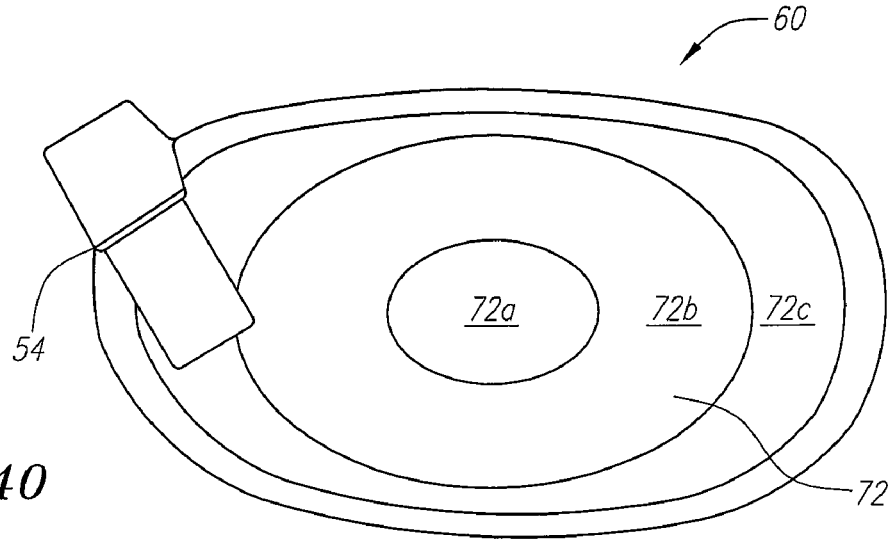
FIG. 40 is an isolated interior view of a face component for a club head of the present invention.
Figure 41:
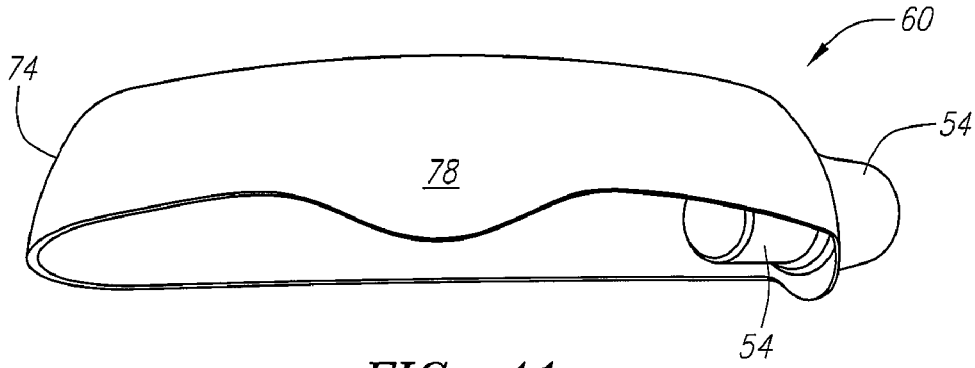
FIG. 41 is an isolated bottom plan view of a face component for a club head of the present invention.
Figure 42:
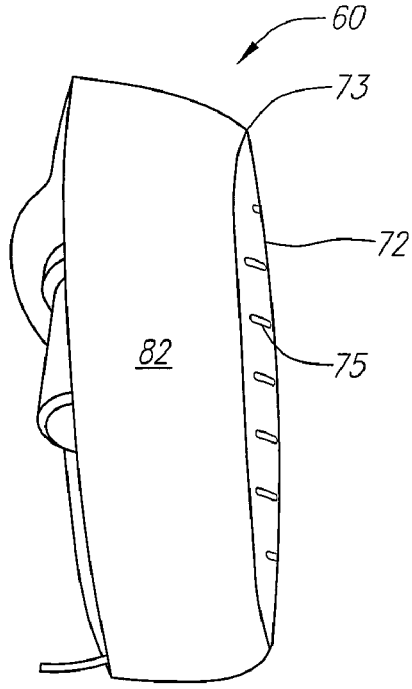
FIG. 42 is an isolated toe side view of a face component for a club head of the present invention.

As shown in FIGS. 40-42, the face component has a striking plate portion 72 with varying thickness wherein portion 72*a* is thicker than 72*b* which is thicker than 72*c*. In a preferred embodiment, the striking plate portion 72 has a varying thickness such as described in U.S. Pat. No. 6,398,666, for a Golf Club Striking Plate With Variable Thickness, which pertinent parts are hereby incorporated by reference. Other alternative embodiments of the thickness of the striking plate portion 72 are disclosed in U.S. Pat. No. 6,471,603, for a Contoured Golf Club Face and U.S. Pat. No. 6,368,234, for a Golf Club Striking Plate Having Elliptical Regions Of Thickness, which are both owned by Callaway Golf Company and which pertinent parts are hereby incorporated by reference. Alternatively, the striking plate portion 72 has a uniform thickness.

As mentioned previously, the face component 60 is preferably forged from a rod of metal material. One preferred forging process for manufacturing the face component is set forth in U.S. Pat. No. 6,440,011, filed on Apr. 13, 2000, entitled Method For Processing A Striking Plate For A Golf Club Head, and hereby incorporated by reference in its entirety. Alternatively, the face component 60 is cast from molten metal in a method such as the well-known lost-wax casting method. The metal for forging or casting is preferably titanium or a titanium alloy such as 6-4 titanium alloy, alpha-beta titanium alloy or beta titanium alloy for forging, and 6-4 titanium for casting.

Additional methods for manufacturing the face component 60 include forming the face component 60 from a flat sheet of metal, super-plastic forming the face component 60 from a flat sheet of metal, machining the face component 60 from a solid block of metal, electrochemical milling the face from a forged pre-form, and like manufacturing methods. Yet further methods include diffusion bonding titanium sheets to yield a variable face thickness face and then superplastic forming.

Alternatively, the face component 60 is composed of an amorphous metal material such as disclosed in U.S. Pat. No. 6,471,604, which was filed on Apr. 4, 2002 and is hereby incorporated by reference in its entirety.

An alternative embodiment of a club head 42 with a face component 60 and aft-body 61 is shown in FIGS. 22-27. In this embodiment, the club head 42 has a plurality of external weights 122*a*' and 122*b*' positioned on the aft-body 61.

Another alternative embodiment of a club head 42 with a face component 60 and aft-body 61 is shown in FIGS. 28-33. Yet another alternative embodiment of a club head 42 with a face component 60 and aft-body 61 is shown in FIGS. 34-39. In this embodiment, the bottom section 91 of the sole portion 64 has a sole inward curvature 333 which creates a first keel point 275 and a second keel point 277 of the club head 42.

In an alternative embodiment of the golf club head 42 of FIGS. 1-7, the body 43 has a front wall with an opening in which a striking plate 72' is preferably disposed within the opening. The body 43 is preferably composed of a non-metal material, preferably a composite material such as a continuous fiber pre-preg material (including thermosetting materials or thermoplastic materials for the resin). Other materials for the body 43 include other thermosetting materials or other thermoplastic materials such as injectable plastics. Further, other materials for the body 43 include magnesium alloys, aluminum alloys, magnesium, aluminum or other low density metals. The body 43 is preferably manufactured through bladder-molding, resin transfer molding, resin infusion, injection molding, compression molding, or a similar process.

The striking plate insert 72' is attached to the body 43 over the opening of the front wall of the body 43. The striking plate insert 72' is preferably composed of a formed metal material. Alternatively the striking plate insert 72' is composed of a machined metal material, a forged metal material, a cast metal material or the like. The striking plate insert 72' preferably is composed of a formed titanium or steel material. A preferred material is steel 4340, which is heat treated and then coated with a titanium nitride. Titanium materials useful for the striking plate insert 40 include pure titanium and titanium alloys such as 6-4 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. Other metals for the striking plate insert 40 include other high strength steel alloy metals and amorphous metals. Such steel materials include 17-4PH, Custom 450, 455, 465 and 465+ stainless steels, AERMET 100 and AERMET 310 alloy steels, all available from Carpenter Specialty Alloys, of Pennsylvania, and C35 maraging steels available from Allvac of North Carolina. Such amorphous metals include beryllium based alloys such as disclosed in U.S. Pat. No. 5,288,344, which pertinent parts are hereby incorporated by reference, quinary metallic glass alloys such as disclosed in U.S. Pat. No. 5,735,975, which pertinent parts are hereby incorporated by reference, and ternary alloys as disclosed in *Calculations of Amorphous-Forming Composition Range For Ternary Alloy Systems And Analyses Of Stabilization Of Amorphous Phase And Amorphous-Forming Ability, Takeuchi and Inoue*, Materials Transactions, Vol. 42, No. 7, p 1435-1444 (2001), which pertinent parts are hereby incorporated by reference.

The striking plate insert 72' is preferably co-molded with a body 43 or press-fitted into the opening subsequent to fabrication of the body 43. In another attachment process, the body 43 is first bladder molded and then the striking plate insert 72' is bonded to a recessed portion of the front wall using an adhesive. The adhesive is placed on the exterior surface of the recessed portion. Such adhesives include thermosetting adhesives in a liquid or a film medium. A preferred adhesive is a two part liquid epoxy sold by 3M of Minneapolis Minn. under the brand names DP420NS and DP460NS. Other alternative adhesives include modified acrylic liquid adhesives such as DP810NS, also sold by the 3M company. Alternatively, foam tapes such as Hysol Synspan may be utilized with the present invention.

Yet another embodiment of the golf club head 42 shown in FIGS. 1-7, the body 43 is preferably composed of a metal material such as titanium, titanium alloy, or the like, and is most preferably composed of a cast titanium alloy material.

The body 43 is preferably cast from molten metal in a method such as the well-known lost-wax casting method. The metal for casting is preferably titanium or a titanium alloy such as 6-4 titanium alloy, alpha-beta titanium alloy or beta titanium alloy for forging, and 6-4 titanium for casting. Alternatively, the body 43 is composed of 17-4 steel alloy. Additional methods for manufacturing the body 43 include forming the body 43 from a flat sheet of metal, super-plastic forming the body 43 from a flat sheet of metal, machining the body 43 from a solid block of metal, electrochemical milling the body from a forged pre-form, casting the body using centrifugal casting, casting the body using levitation casting, and like manufacturing methods.

The golf club head 42 of this embodiment optionally has a front wall with an opening for placement of a striking plate insert 72' such as disclosed in U.S. Pat. No. 6,902,497 for A Golf Club Head With A Face Insert. The striking plate insert 72' preferably is composed of a formed titanium alloy material. Such titanium materials include titanium alloys such as 6-22-22 titanium alloy and Ti 10-2-3 alloy, Beta-C titanium alloy, all available from RTI International Metals of Ohio, SP-700 titanium alloy (available from Nippon Steel of Tokyo, Japan), DAT 55G titanium alloy available from Diado Steel of Tokyo, Japan, and like materials. The preferred material for the striking plate insert 72' is a heat treated 6-22-22 titanium alloy which is a titanium alloy composed by weight of titanium, 6% aluminum, 2% tin, 2% chromium, 2% molybdenum, 2% zirconium and 0.23% silicon. The titanium alloy will have an alpha phase in excess of 40% of the overall microstructure.

In a preferred embodiment, the striking plate insert 72' has uniform thickness that ranges from 0.040 inch to 0.250 inch, more preferably a thickness of 0.080 inch to 0.120 inch, and is most preferably 0.108 inch for a titanium alloy striking plate insert 72'.

In yet another embodiment for the golf club head 42 shown in FIGS. 1-7, the golf club head has a construction with a crown composed of plies of pre-preg material such as disclosed in U.S. Pat. No. 6,575,845, for a Multiple Material Golf Club Head, which pertinent parts are hereby incorporated by reference.

In yet another embodiment, the golf club head 42 has a shape as disclosed, particularly as shown in FIGS. 1-7, and a construction with a body composed of plies of pre-preg material such as disclosed in U.S. Pat. No. 6,607,452, for a High Moment Of Inertia Composite Golf Club Head, which pertinent parts are hereby incorporated by reference.

In a preferred embodiment, the golf club head 42 has a high coefficient of restitution thereby enabling for greater distance of a golf ball hit with the golf club 40. The coefficient of restitution (also referred to herein as "COR") is determined by the following equation:

$$e = \frac{v_2 - v_1}{U_1 - U_2}$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The present invention provides a club head having a coefficient of restitution ranging from 0.81 to 0.94, as measured under conventional test conditions.

The coefficient of restitution of the club head 42 under standard USGA test conditions with a given ball ranges from approximately 0.81 to 0.94, preferably ranges from 0.825 to 0.883 and is most preferably 0.845.

Additionally, the striking plate portion 72 of the face component 60 has a more rectangular face providing a greater aspect ratio. The aspect ratio as used herein is defined as the width, "W", of the face divided by the height, "H", of the face. In one preferred embodiment, the width W is 100 millimeters and the height H is 56 millimeters giving an aspect ratio of 1.8. The striking plate portion 72 of the present invention preferably has an aspect ratio that is greater than 1.8 for a club head having a volume greater than 420 cubic centimeters.

The face area of the striking plate portion 72 preferably ranges from 5.00 square inches to 10.0 square inches, more preferably from 6.0 square inches to 9.5 square inches, and most preferably from 7.0 square inches to 9.0 square inches.

Figure 23:
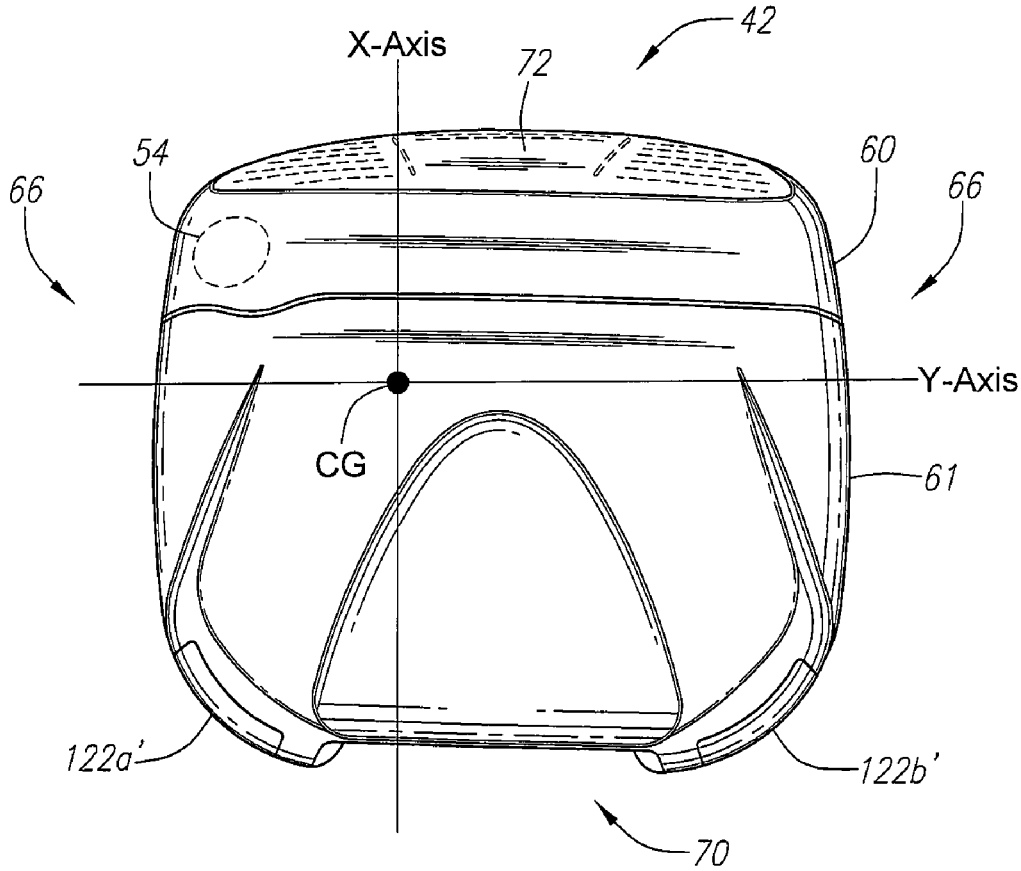
FIG. 23 is a top plan view of the club head of FIG. 22.
Figure 24:
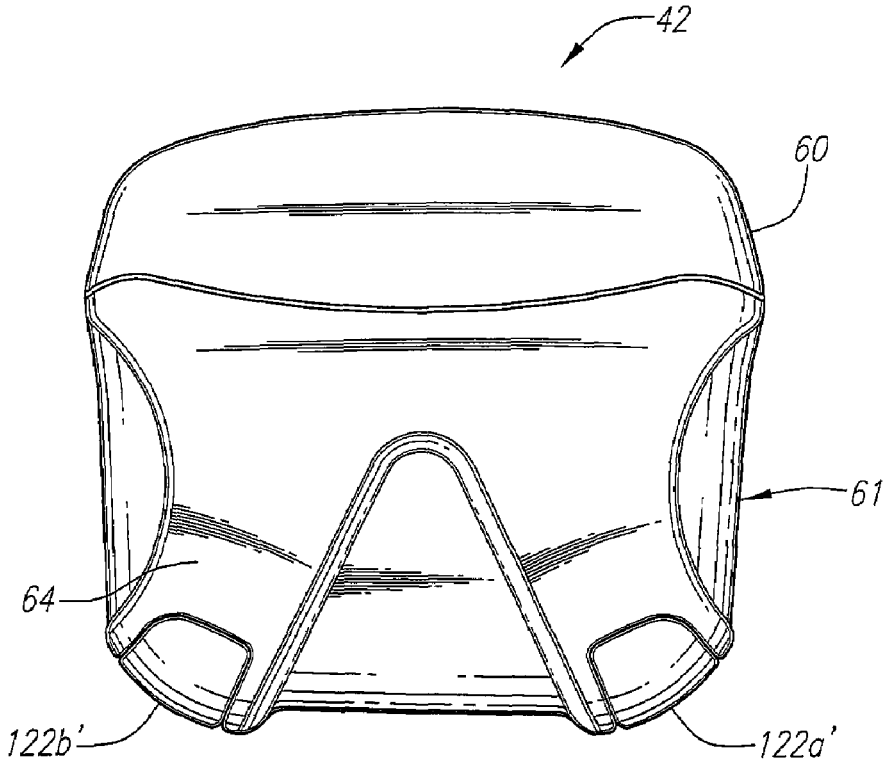
FIG. 24 is a bottom plan view of the club head of FIG. 22.
Figure 25:
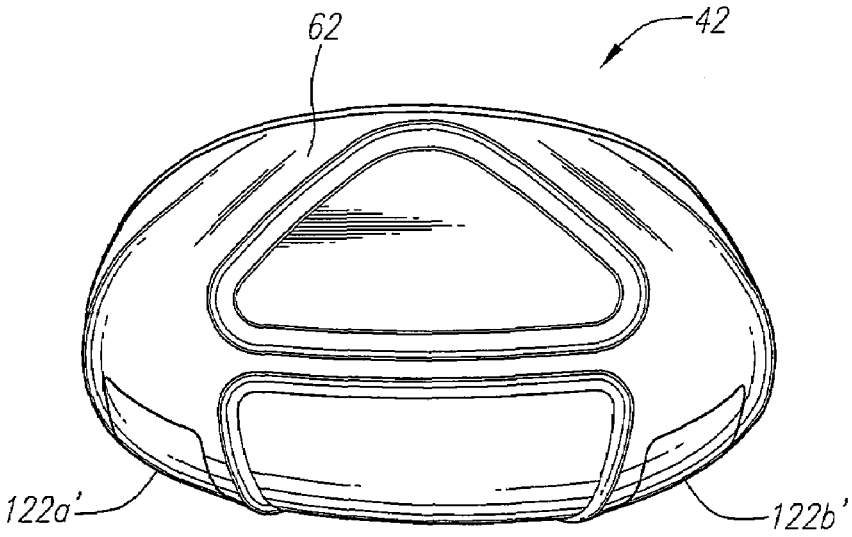
FIG. 25 is a rear plan view of the club head of FIG. 22.
Figure 26:
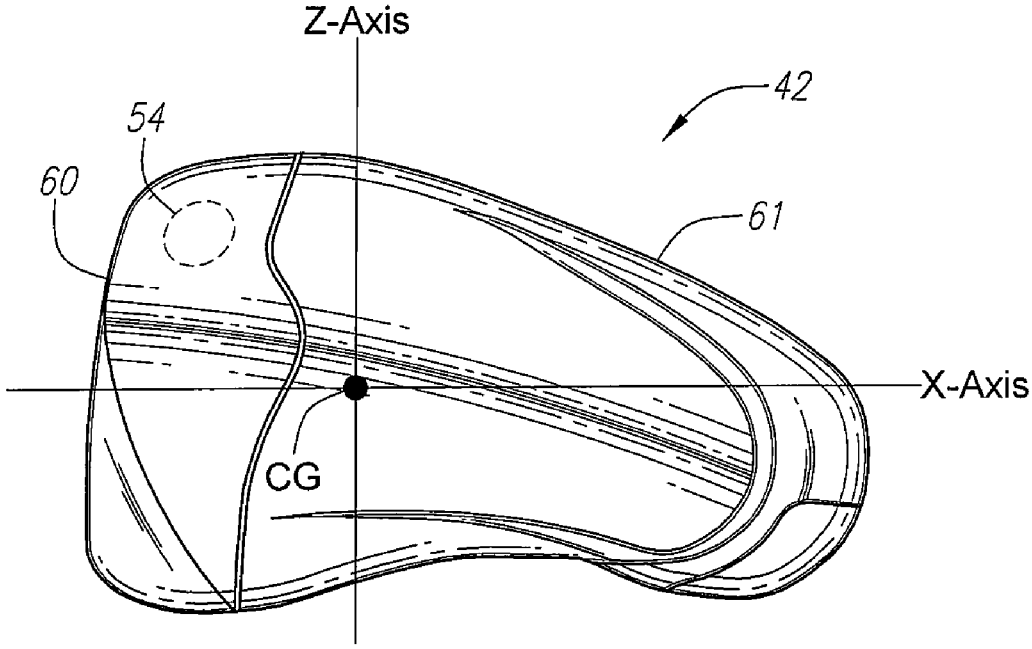
FIG. 26 is a heel side view of the club head of FIG. 22.
Figure 27:
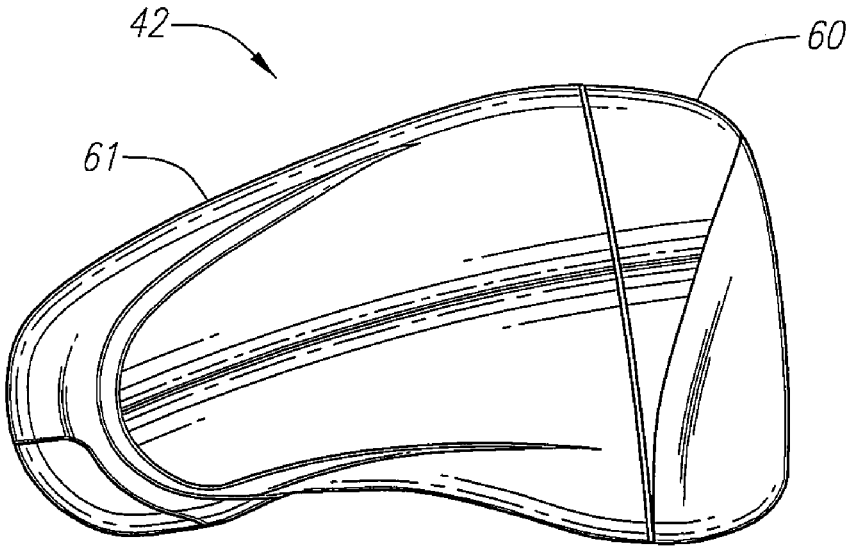
FIG. 27 is a toe side view of the club head of FIG. 22.
Figure 28:
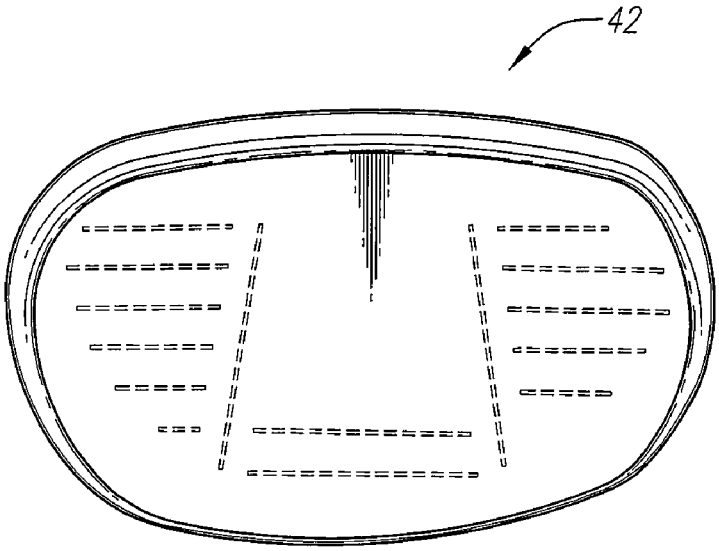
FIG. 28 is a front view of an alternative embodiment of a club head of the present invention.
Figure 29:
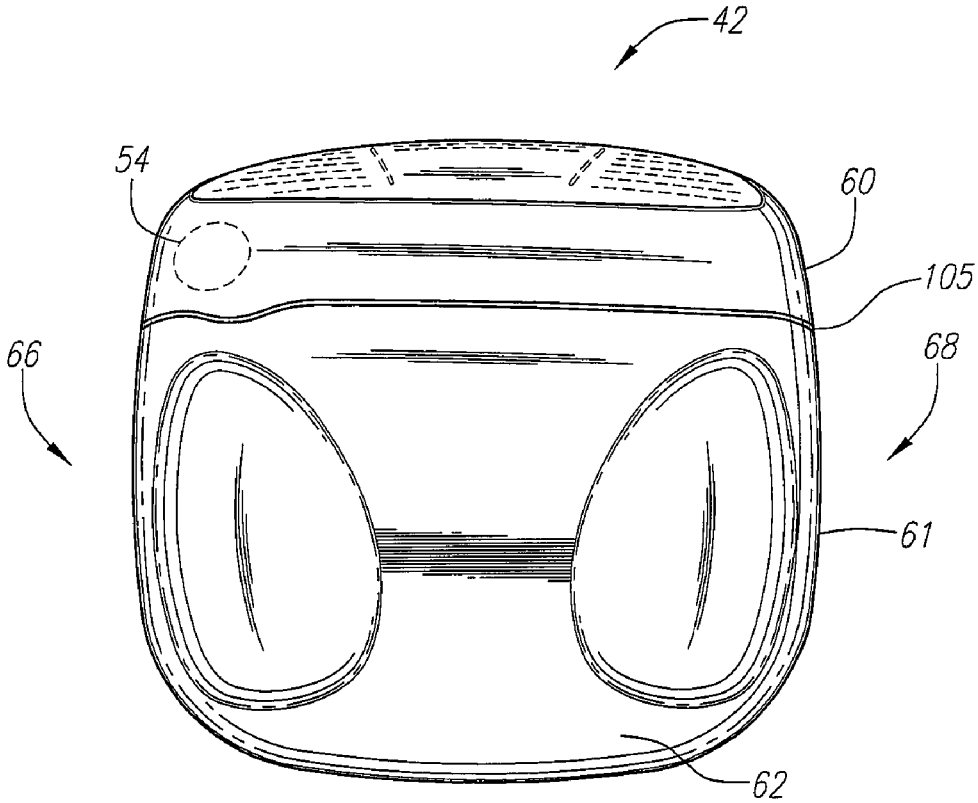
FIG. 29 is a top plan view of the club head of FIG. 28.
Figure 30:
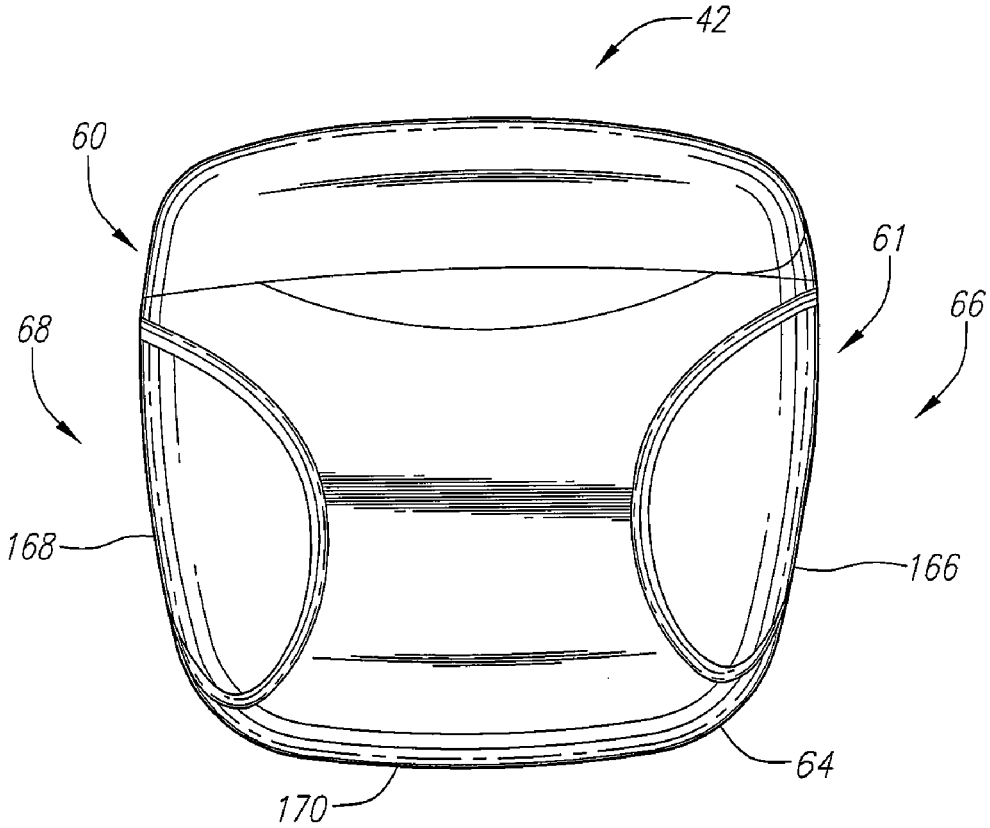
FIG. 30 is a bottom plan view of the club head of FIG. 28.
Figure 31:
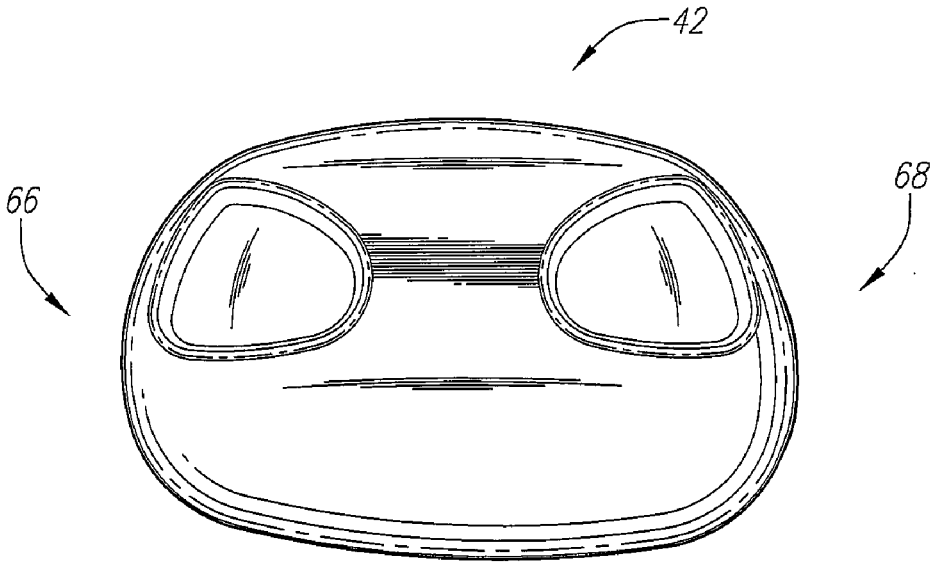
FIG. 31 is a rear plan view of the club head of FIG. 28.
Figure 32:
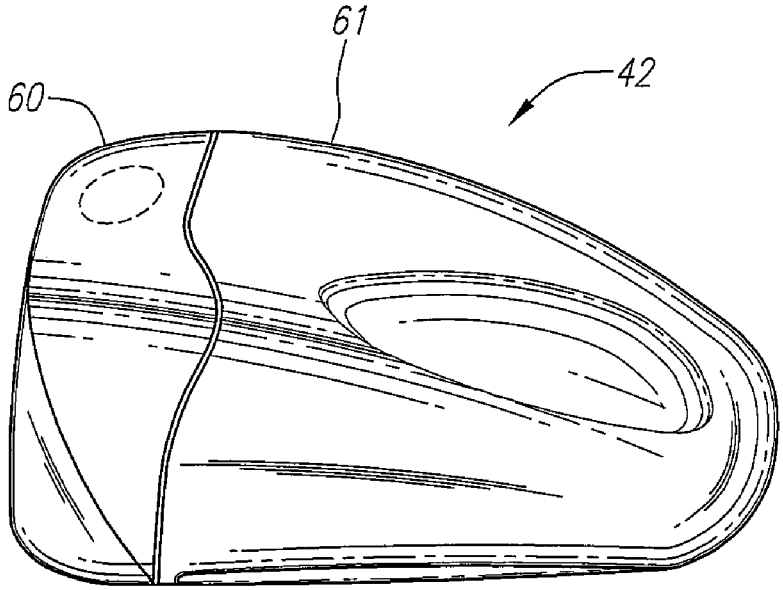
FIG. 32 is a heel side view of the club head of FIG. 28.
Figure 33:
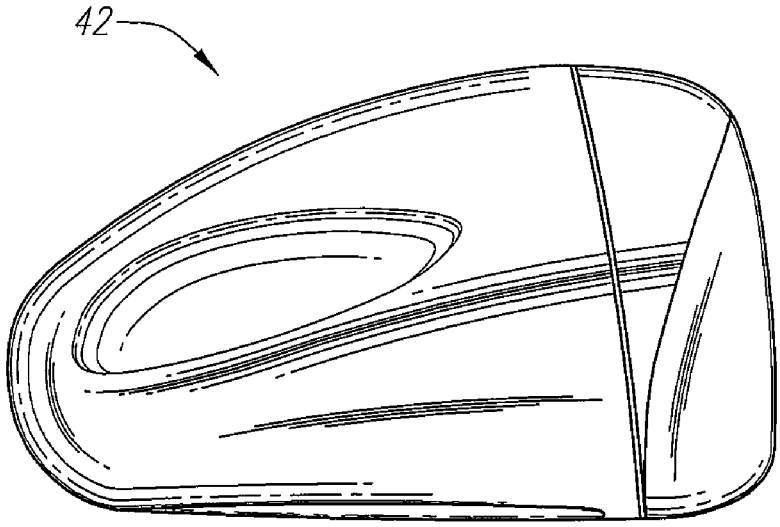
FIG. 33 is a toe side view of the club head of FIG. 28.
Figure 34:
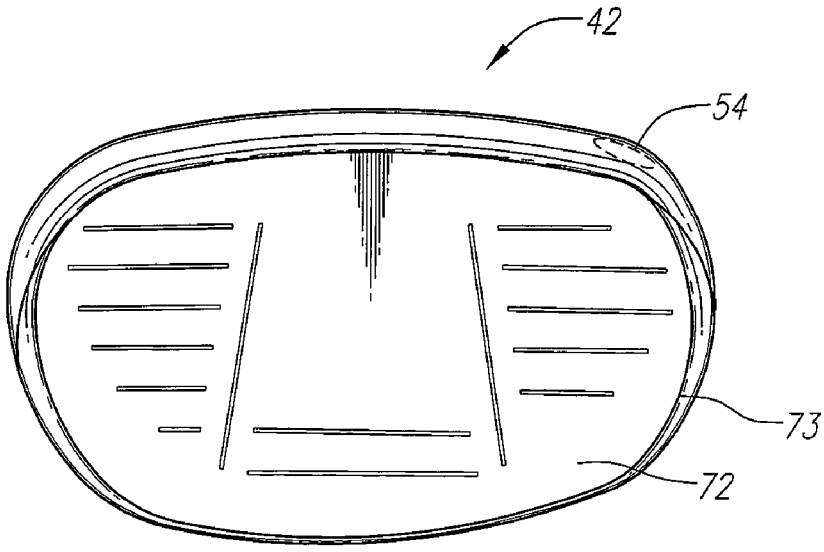
FIG. 34 is a front view of an alternative embodiment of a club head of the present invention.
Figure 35:
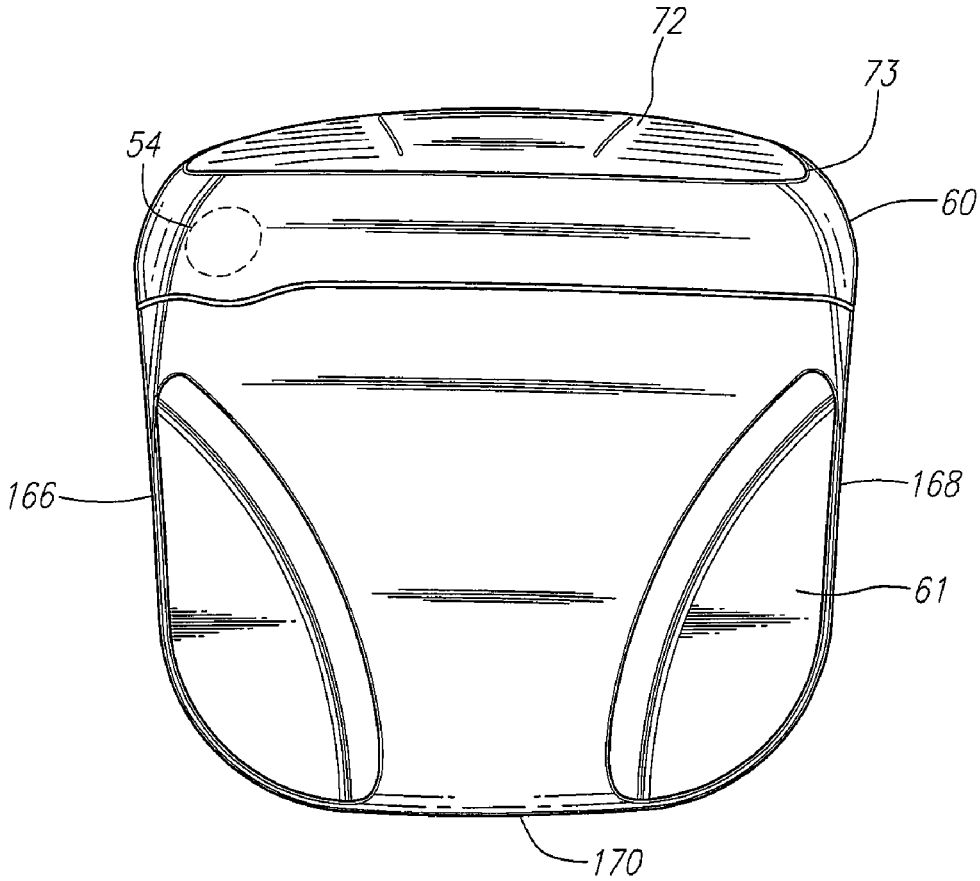
FIG. 35 is a top plan view of the club head of FIG. 34.
Figure 36:
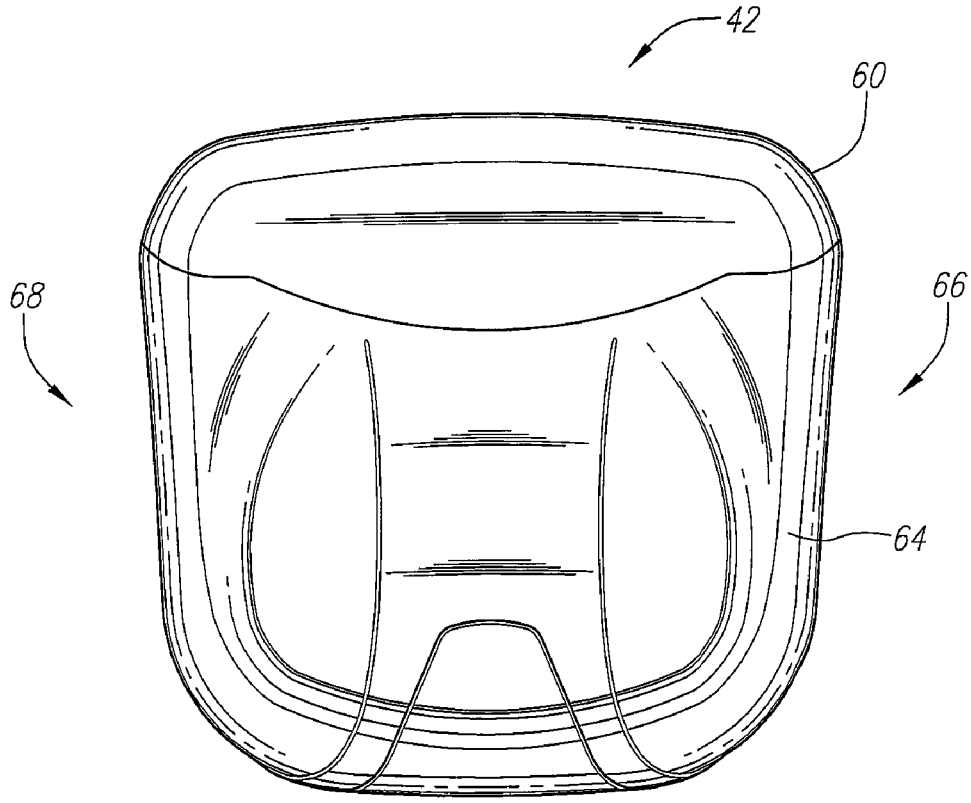
FIG. 36 is a bottom plan view of the club head of FIG. 34.
Figure 37:
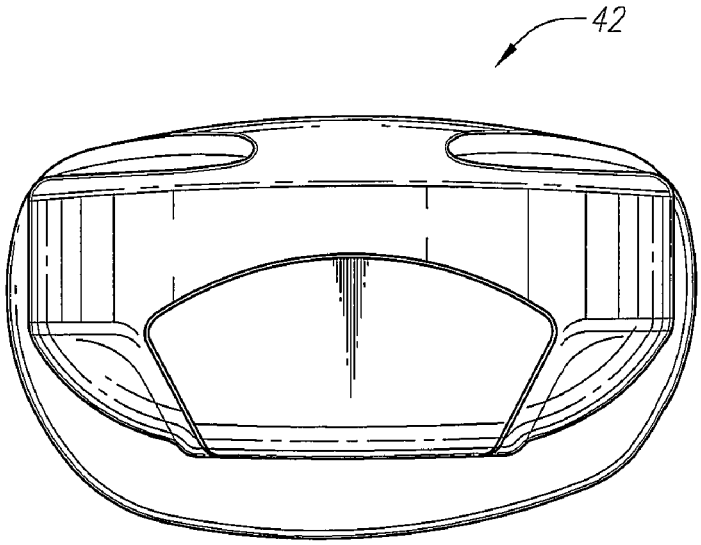
FIG. 37 is a rear plan view of the club head of FIG. 34.
Figure 38:
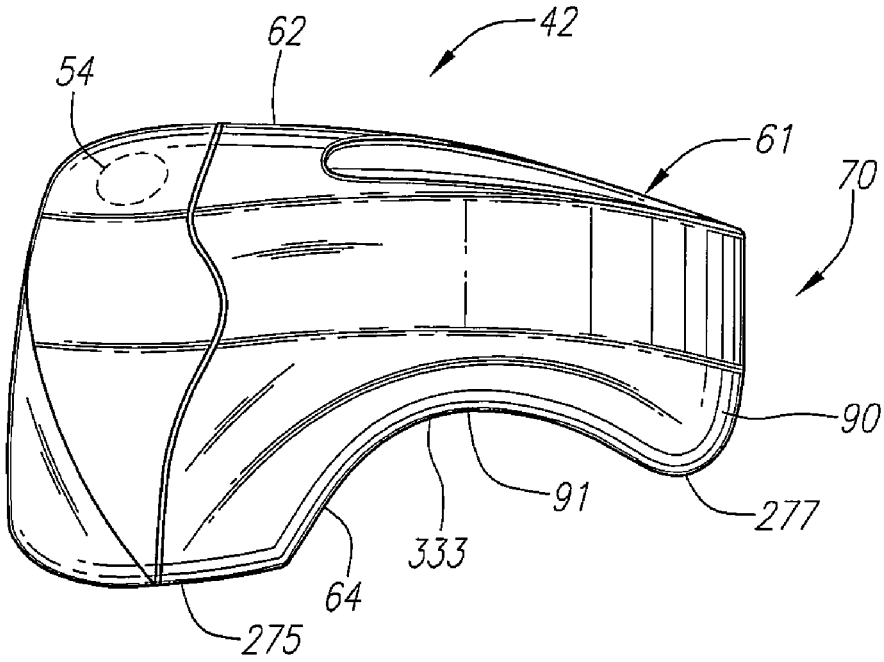
FIG. 38 is a heel side view of the club head of FIG. 34.
Figure 39:
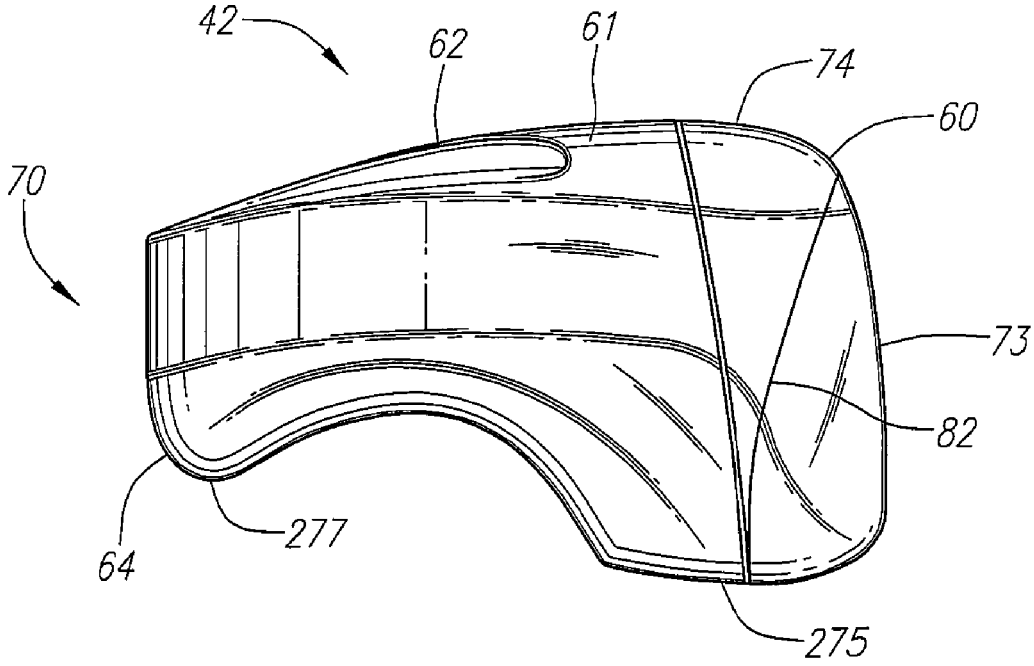
FIG. 39 is a toe side view of the club head of FIG. 34.

FIGS. 23 and 26 illustrate the axes of inertia through the center of gravity of the golf club head. The axes of inertia are designated X, Y and Z. The X-axis extends from the striking plate portion 72 through the center of gravity, CG, and to the rear of the golf club head 42. The Y-axis extends from the toe end 68 of the golf club head 42 through the center of gravity, CG, and to the heel end 66 of the golf club head 42. The Z-axis extends from the crown portion 62 through the center of gravity, CG, and through the sole portion 64.

As defined in *Golf Club Design, Fitting, Alteration & Repair,* $4^{th}$ Edition, by Ralph Maltby, the center of gravity, or center of mass, of the golf club head is a point inside of the club head determined by the vertical intersection of two or more points where the club head balances when suspended. A more thorough explanation of this definition of the center of gravity is provided in *Golf Club Design, Fitting, Alteration & Repair.*

The center of gravity and the moment of inertia of a golf club head 42 are preferably measured using a test frame ($X^T$, $Y^T$, $Z^T$), and then transformed to a head frame ($X^H$, $Y^H$, $Z^H$). The center of gravity of a golf club head may be obtained using a center of gravity table having two weight scales thereon, as disclosed in U.S. Pat. No. 6,607,452, entitled High Moment Of Inertia Composite Golf Club, and hereby incorporated by reference in its entirety. If a shaft is present, it is removed and replaced with a hosel cube that has a multitude of faces normal to the axes of the golf club head. Given the weight of the golf club head, the scales allow one to determine the weight distribution of the golf club head when the golf club head is placed on both scales simultaneously and weighed along a particular direction, the X, Y or Z direction. Those skilled in the pertinent art will recognize other methods to determine the center of gravity and moments of inertia of a golf club head.

In general, the moment of inertia, Izz, about the Z axis for the golf club head 42 of the present invention will range from 3500 g-cm$^2$ to 6000 g-cm$^2$, preferably from 4000 g-cm$^2$ to 5000 g-cm$^2$, and most preferably from 4200 g-cm$^2$ to 4750 g-cm$^2$. The moment of inertia, Iyy, about the Y axis for the golf club head 42 of the present invention will range from 2000 g-cm$^2$ to 4000 g-cm$^2$, preferably from 2500 g-cm$^2$ to 3500 g-cm$^2$, and most preferably from 2900 g-cm$^2$ to 3300 g-cm$^2$. The moment of inertia, Ixx, about the X axis for the golf club head 42 of the present invention will range from 2000 g-cm$^2$ to 4000 g-cm$^2$, preferably from 2500 g-cm$^2$ to 3750 g-cm$^2$, and most preferably from 3000 g-cm$^2$ to 3500 g-cm$^2$.

In general, the golf club head 42 has products of inertia such as disclosed in U.S. Pat. No. 6,425,832, which was filed on Jul. 26, 2001 and is hereby incorporated by reference in its entirety. Preferably, each of the products of inertia, Ixy, Ixz and Iyz, of the golf club head 42 have an absolute value less than 100 grams-centimeter squared. Alternatively, at least two of the products of inertia, Ixy, Ixz or Iyz, of the golf club head 42 have an absolute value less than 100 grams-centimeter squared.

FIGS. 17-21 illustrate the substantial straightness of the heel wall 166, the toe wall 168 and the rear wall 170 of the club head 42. In a preferred embodiment, at least 50% of the length of the heel wall 166 extends rearward from the perimeter 73 of the striking plate portion 72 within an angle of 80 degrees to 90 degrees relative to a plane parallel to the farthest extent of the striking plate portion 72. For example, in FIG. 18, line 502 represents a plane parallel to the farthest extent of the striking plate portion 72 and line 503 is at an angle of 90 degrees relative to line 502. Shown in a dashed line is a line at 80 degrees relative to line 502. In a more preferred embodiment, at least 66% of the length of the heel wall 166 extends rearward from the perimeter 73 of the striking plate portion 72 within an angle of 80 degrees to 90 degrees relative to a plane parallel to the farthest extent of the striking plate portion 72. In yet an even more preferred embodiment, at least 75% of the length of the heel wall 166 extends rearward from the perimeter 73 of the striking plate portion 72 within an angle of 80 degrees to 90 degrees relative to a plane parallel to the farthest extent of the striking plate portion 72. In yet a further more preferred embodiment, at least 90% of the length or even at least 95% of the length of the heel wall 166 extends rearward from the perimeter 73 of the striking plate portion 72 within an angle of 80 degrees to 90 degrees relative to a plane parallel to the farthest extent of the striking plate portion 72. Further, 50% to 95% of the length of the heel wall 166 preferably extends rearward from the perimeter 73 of the striking plate portion 72 within an angle of 80 degrees to 90 degrees relative to a plane parallel to the farthest extent of the striking plate portion 72, more preferably 66% to 80%.

In a preferred embodiment, at least 50% of the length of the toe wall 168 extends rearward from the perimeter 73 of the striking plate portion 72 within an angle of 80 degrees to 90 degrees relative to a plane parallel to the farthest extent of the striking plate portion 72. For example, in FIG. 20, line 504 represents a plane parallel to the farthest extent of the striking plate portion 72 and line 504 is at an angle of 90 degrees relative to line 504. Shown in a dashed line is a line at 80 degrees relative to line 502. In a more preferred embodiment, at least 66% of the length of the toe wall 168 extends rearward from the perimeter 73 of the striking plate portion 72 within an angle of 80 degrees to 90 degrees relative to a plane parallel to the farthest extent of the striking plate portion 72. In yet an even more preferred embodiment, at least 75% of the length of the toe wall 168 extends rearward from the perimeter 73 of the striking plate portion 72 within an angle of 80 degrees to 90 degrees relative to a plane parallel to the farthest extent of the striking plate portion 72. In yet a further more preferred embodiment, at least 90% of the length or even at least 95% of the length of the toe wall 168 extends rearward from the perimeter 73 of the striking plate portion 72 within an angle of 80 degrees to 90 degrees relative to a plane parallel to the farthest extent of the striking plate portion 72. Further, 50% to 95% of the length of the toe wall 168 preferably extends rearward from the perimeter 73 of the striking plate portion 72 within an angle of 80 degrees to 90 degrees relative to a plane parallel to the farthest extent of the striking plate portion 72, more preferably 66% to 80%.

In a preferred embodiment, at least 50% of the length of the rear wall 170 extends substantially parallel with a farthest extent of the striking plate portion 72 within an angle of 80 degrees to 90 degrees relative to a plane parallel to the farthest extent of the heel wall 166. For example, in FIG. 17, line 501 represents a plane parallel to the farthest extent of the heel wall 166 and line 500 is at an angle of 90 degrees relative to line 501. Shown in a dashed line is a line at 80 degrees relative to line 501 and a line at 60 degrees relative to line 501. In a more preferred embodiment, at least 66% of the length of the rear wall 170 extends substantially parallel with a farthest extent of the striking plate portion 72 within an angle of 80 degrees to 90 degrees relative to a plane parallel to the farthest extent of the heel wall 166. In yet an even more preferred embodiment, at least 75% of the length of the rear wall 170 extends substantially parallel with a farthest extent of the striking plate portion 72 within an angle of 80 degrees to 90 degrees relative to a plane parallel to the farthest extent of the heel wall 166. In yet a further more preferred embodiment, at least 90% of the length of the heel wall 170 extends substantially parallel with a farthest extent of the striking plate portion 72 within an angle of 80 degrees to 90 degrees relative to a plane parallel to the farthest extent of the heel wall 166. Further, 50% to 95% of the length of the rear wall 170 preferably extends substantially parallel with a farthest extent of the striking plate portion 72 within an angle of 80 degrees to 90 degrees relative to a plane parallel to the farthest extent of the heel wall 166, more preferably 66% to 80%.

Figure 21:
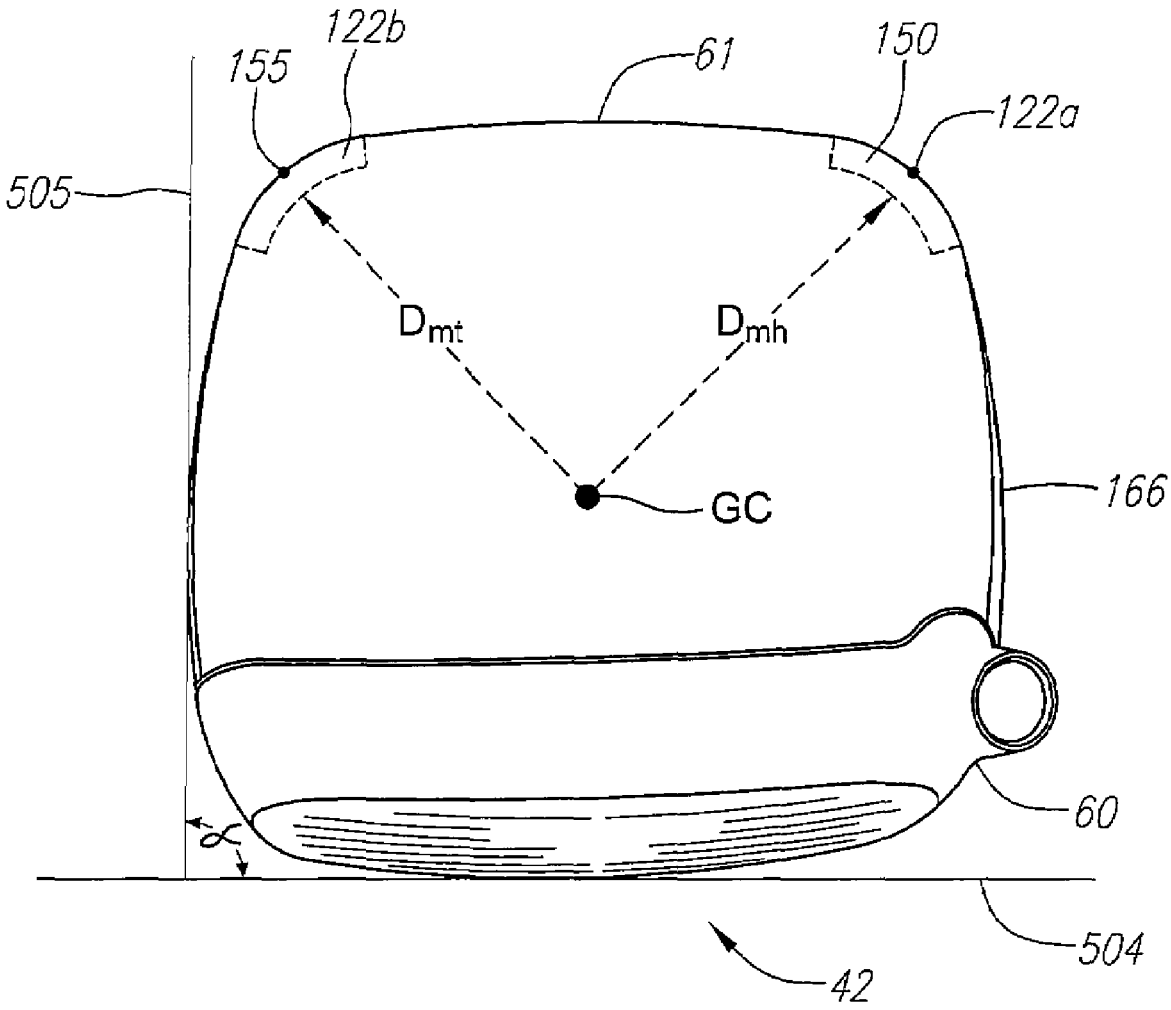
FIG. 21 is a top plan view of a club head of the present invention illustrating the wall angles relative to each other.
Figure 22:
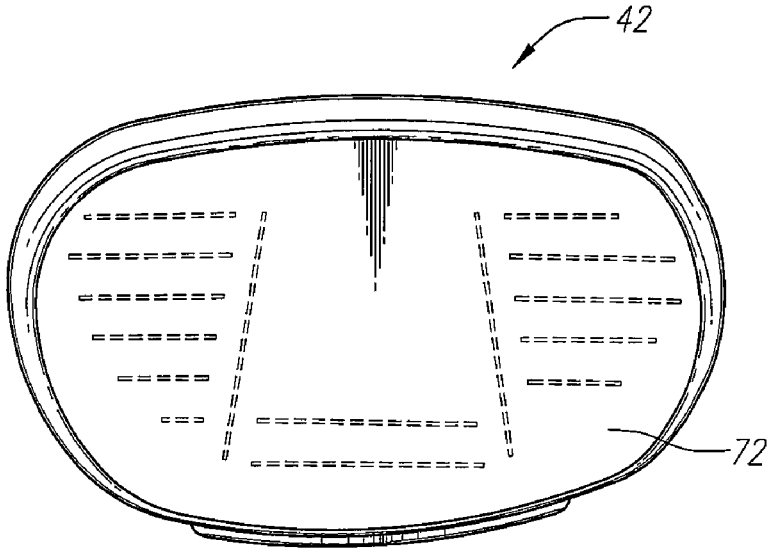
FIG. 22 is a front view of an alternative embodiment of a club head of the present invention.

As shown in FIG. 21, a distance "Dmh" from the center of gravity, CG, of the club head 42 to an aft-heel edge point 150 ranges from 1.0 inches to 3.5 inches, and more preferably from 2.0 inches to 3.0 inches, and is most preferably 2.25 inches. A distance "Dmt" from the geometric center to an aft-toe edge point 155 ranges from 1.75 inches to 4.0 inches, and more preferably from 2.5 inches to 3.75 inches, and is most preferably 3.25 inches. In a preferred embodiment, the distance Dmt is the farthest distance of any point on the club head 42 from the center of gravity of the club head 42. Further, with a weighting member 122*b* positioned at about aft-toe edge point 155, the weighting member 122*b* represents the greatest mass in the least volume the farthest away from the center of gravity of the club head 42.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A wood-type golf club head comprising:

a body composed of a titanium alloy material, the body comprising a crown, a sole and a front wall having a perimeter, a heel wall extending 2.0 inches to 5.0 inches rearward from the perimeter of the front wall, an aft wall substantially perpendicular to the heel wall, the aft wall extending from 2.5 inches to 5.5 inches from an aft edge of the heel wall, and a toe wall substantially perpendicular to the aft wall, the toe wall extending from 2.0 inches to 5.0 inches from an aft edge of the toe wall, wherein the crown, the sole, the front wall, the heel wall, the aft wall and the toe wall define a hollow interior;

wherein the golf club head has a volume ranging from 420 cubic centimeters to 470 cubic centimeters, a moment of inertia, Izz, about the center of gravity of the golf club head greater than 4000 grams-centimeters squared, and a moment of inertia, Iyy, about the center of gravity of the golf club head ranging from 2000 grams-centimeters squared to 4000 grams-centimeters squared;

wherein the heel wall extends rearward from a perimeter of the front wall a distance of least 50% of the length of the heel wall at an angle of 80 degrees to 90 degrees relative to relative to a plane parallel to the farthest extent of the face.

2. The wood-type golf club head according to claim 1 wherein the heel wall, the aft wall and the toe wall each have the same height.

3. The wood-type golf club head according to claim 2 wherein the heel wall, the aft wall and the toe wall each have a height ranging from 1.5 inches to 3.0 inches.

4. The wood-type golf club head according to claim 1 wherein the body has a geometric center point, an aft-heel edge point and an aft-toe edge point, wherein the distance from the geometric center point to the aft-heel edge point is equal to the distance from the geometric center point to the aft-toe edge point.

5. The wood-type golf club head according to claim 4 further comprising an aft-heel curvature section between the aft wall and the heel wall, and an aft-toe curvature section between the aft wall and the toe wall.

6. The wood-type golf club head according to claim 1 wherein the heel wall extends rearward from a perimeter of the front wall a distance of least 75% of the length of the heel wall at an angle of 80 degrees to 90 degrees relative to a plane parallel to the farthest extent of the face.

7. The wood-type golf club head according to claim 1 wherein the heel wall extends rearward from a perimeter of the front wall a distance of least 90% of the length of the heel wall at an angle of 80 degrees to 90 degrees relative to a plane parallel to the farthest extent of the face.

8. A wood-type golf club head comprising:

a body composed of a steel material, the body comprising a crown, a sole and a front wall having a perimeter, a heel wall extending 2.0 inches to 5.0 inches rearward from the perimeter of the front wall, an aft wall substantially perpendicular to the heel wall, the aft wall extending from 2.5 inches to 5.5 inches from an aft edge of the heel wall, and a toe wall substantially perpendicular to the aft wall, the toe wall extending from 2.0 inches to 5.0 inches from an aft edge of the toe wall, wherein the crown, the sole, the front wall, the heel wall, the aft wall and the toe wall define a hollow interior;

wherein the golf club head has a volume ranging from 420 cubic centimeters to 470 cubic centimeters, a moment of inertia, Izz, about the center of gravity of the golf club head greater than 4000 grams-centimeters squared, and a moment of inertia, Iyy, about the center of gravity of the golf club head ranging from 2000 grams-centimeters squared to 4000 grams-centimeters squared;

wherein the heel wall extends rearward from a perimeter of the front wall a distance of least 50% of the length of the heel wall at an angle of 80 degrees to 90 degrees relative to relative to a plane parallel to the farthest extent of the face.

9. The wood-type golf club head according to claim 8 wherein the heel wall, the aft wall and the toe wall each have the same height.

10. The wood-type golf club head according to claim 9 wherein the heel wall, the aft wall and the toe wall each have a height ranging from 1.5 inches to 3.0 inches.

11. The wood-type golf club head according to claim 8 wherein the body has a geometric center point, an aft-heel edge point and an aft-toe edge point, wherein the distance from the geometric center point to the aft-heel edge point is equal to the distance from the geometric center point to the aft-toe edge point.

12. The wood-type golf club head according to claim 11 further comprising an aft-heel curvature section between the aft wall and the heel wall, and an aft-toe curvature section between the aft wall and the toe wall.

13. The wood-type golf club head according to claim 8 wherein the heel wall extends rearward from a perimeter of the front wall a distance of least 75% of the length of the heel wall at an angle of 80 degrees to 90 degrees relative to a plane parallel to the farthest extent of the face.

14. The wood-type golf club head according to claim 8 wherein the heel wall extends rearward from a perimeter of the front wall a distance of least 90% of the length of the heel wall at an angle of 80 degrees to 90 degrees relative to a plane parallel to the farthest extent of the face.

15. A wood-type golf club head comprising:

a body composed of a non-metal material, the body comprising a crown, a sole and a front wall having an opening and a perimeter, a heel wall extending 2.0 inches to 5.0 inches rearward from the perimeter of the front wall, an aft wall substantially perpendicular to the heel wall, the aft wall extending from 2.5 inches to 5.5 inches from an aft edge of the heel wall, and a toe wall substantially perpendicular to the aft wall, the toe wall extending from 2.0 inches to 5.0 inches from an aft edge of the toe wall, wherein the crown, the sole, the front wall, the heel wall, the aft wall and the toe wall define a hollow interior;

a striking plate positioned in the opening of the front wall of the body, the striking plate composed of a metal material;

wherein the golf club head has a volume ranging from 420 cubic centimeters to 470 cubic centimeters, a moment of inertia, Izz, about the center of gravity of the golf club head greater than 4000 grams-centimeters squared, and a moment of inertia, Iyy, about the center of gravity of the golf club head ranging from 2000 grams-centimeters squared to 4000 grams-centimeters squared;

wherein the heel wall extends rearward from a perimeter of the front wall a distance of least 50% of the length of the heel wall at an angle of 80 degrees to 90 degrees relative to relative to a plane parallel to the farthest extent of the face.

16. The wood-type golf club head according to claim 15 wherein the heel wall, the aft wall and the toe wall each have the same height.

17. The wood-type golf club head according to claim 16 wherein the heel wall, the aft wall and the toe wall each have a height ranging from 1.5 inches to 3.0 inches.

18. The wood-type golf club head according to claim 15 wherein the body has a geometric center point, an aft-heel edge point and an aft-toe edge point, wherein the distance from the geometric center point to the aft-heel edge point is equal to the distance from the geometric center point to the aft-toe edge point.

19. The wood-type golf club head according to claim 18 further comprising an aft-heel curvature section between the aft wall and the heel wall, and an aft-toe curvature section between the aft wall and the toe wall.

20. The wood-type golf club head according to claim 15 wherein the heel wall extends rearward from a perimeter of the front wall a distance of least 75% of the length of the heel wall at an angle of 80 degrees to 90 degrees relative to a plane parallel to the farthest extent of the face.

* * * * *